US010347082B2

(12) United States Patent
Filipour et al.

(10) Patent No.: US 10,347,082 B2
(45) Date of Patent: Jul. 9, 2019

(54) GAMING SYSTEM AND METHOD PROVIDING A SKILL-BASED WAGERING GAME WITH AN AVERAGE EXPECTED PAYBACK PERCENTAGE DETERMINED BASED ON PLAYER SKILL LEVEL

(71) Applicant: IGT, Las Vegas, NV (US)

(72) Inventors: Cameron Filipour, Las Vegas, NV (US); Bryan Upton, Hertfordshire (GB); Alex Traikov, Riverview (CA)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 15/675,161

(22) Filed: Aug. 11, 2017

(65) Prior Publication Data

US 2018/0089942 A1 Mar. 29, 2018

Related U.S. Application Data

(60) Provisional application No. 62/398,977, filed on Sep. 23, 2016.

(51) Int. Cl.
*G07F 17/32* (2006.01)

(52) U.S. Cl.
CPC ..... *G07F 17/3244* (2013.01); *G07F 17/3267* (2013.01)

(58) Field of Classification Search
CPC ..... G07F 17/32; G07F 17/3213; G07F 17/3262; G07F 17/3629
See application file for complete search history.

(56) References Cited

U.S. PATENT DOCUMENTS

| | | | |
|---|---|---|---|
| 5,769,716 | A | 6/1998 | Saffari et al. |
| 6,050,895 | A | 4/2000 | Luciano, Jr. et al. |
| 6,572,473 | B1 | 6/2003 | Baerlocher |
| 6,609,974 | B2 | 8/2003 | Mead et al. |
| 6,666,766 | B2 | 12/2003 | Baerlocher et al. |
| 6,761,632 | B2 | 7/2004 | Bansemer et al. |
| 6,852,027 | B2 | 2/2005 | Kaminkow et al. |
| 6,939,224 | B2 | 9/2005 | Palmer et al. |
| 6,942,568 | B2 | 9/2005 | Baerlocher |
| 6,984,174 | B2 | 1/2006 | Cannon et al. |
| 6,988,732 | B2 | 1/2006 | Vancura |
| 7,175,521 | B2 | 2/2007 | McClintic |
| 7,326,115 | B2 | 2/2008 | Baerlocher |

(Continued)

*Primary Examiner* — James S McClellan
(74) *Attorney, Agent, or Firm* — Neal, Gerber & Eisenberg LLP

(57) ABSTRACT

The gaming systems and methods of the present disclosure provide a skill-based wagering game and determining the AEP % for each play based on the player's skill level. Generally, for a play of the skill-based wagering game, the gaming system receives a skill-based input from a player, derives a player skill level from the skill-based input, and determines an AEP % for the play based on the player skill level. The AEP % ranges from a minimum, nonzero AEP % to a maximum AEP %. The higher the player's skill level, the closer the AEP % is to the maximum AEP %, and vice-versa. The nonzero minimum AEP % appeals to low- and medium-skill players since they have a chance to win awards even if they perform poorly for a given play. High-skill players enjoy an advantage over their low- and medium-skill counterparts since they can use their high skill level to achieve comparatively higher AEP %'s.

24 Claims, 23 Drawing Sheets

(56) References Cited

U.S. PATENT DOCUMENTS

| | | | | |
|---|---|---|---|---|
| 7,384,337 | B2 | 6/2008 | Thomas | |
| 7,556,267 | B2 | 7/2009 | Vancura et al. | |
| 8,033,912 | B2 | 10/2011 | Cannon | |
| 8,162,742 | B2 | 4/2012 | Oberberger | |
| 8,398,475 | B2 | 3/2013 | De Waal et al. | |
| 8,419,549 | B2 | 4/2013 | Kaminkow et al. | |
| 8,435,111 | B2 | 5/2013 | Filipour et al. | |
| 8,851,973 | B2 | 10/2014 | Mayeroff et al. | |
| 8,858,321 | B2 | 10/2014 | Popovich et al. | |
| 8,864,564 | B2 | 10/2014 | Oberberger | |
| 8,911,288 | B2 | 12/2014 | Saffari et al. | |
| 8,926,423 | B2 | 1/2015 | Filipour et al. | |
| 8,974,279 | B1 | 3/2015 | Nowak et al. | |
| 9,526,982 | B2 | 12/2016 | Norden | |
| 9,530,281 | B2 | 12/2016 | Basallo et al. | |
| 2002/0077165 | A1* | 6/2002 | Bansemer | A63F 9/0291 463/7 |
| 2009/0191946 | A1* | 7/2009 | Thomas | G07F 17/32 463/20 |
| 2010/0130280 | A1* | 5/2010 | Arezina | G07F 17/3206 463/20 |
| 2012/0077569 | A1* | 3/2012 | Watkins | G07F 17/3267 463/25 |
| 2012/0115581 | A1* | 5/2012 | Englman | G07F 17/34 463/25 |
| 2012/0122553 | A1* | 5/2012 | Bunch | G07F 17/32 463/23 |
| 2014/0087844 | A1* | 3/2014 | Gilliland | A63F 13/00 463/25 |
| 2016/0125697 | A1 | 5/2016 | Oberberger | |
| 2018/0012454 | A1 | 1/2018 | Thirumaleshwar | |
| 2018/0082535 | A1 | 3/2018 | Filipour et al. | |
| 2018/0089960 | A1 | 3/2018 | Caputo et al. | |

* cited by examiner

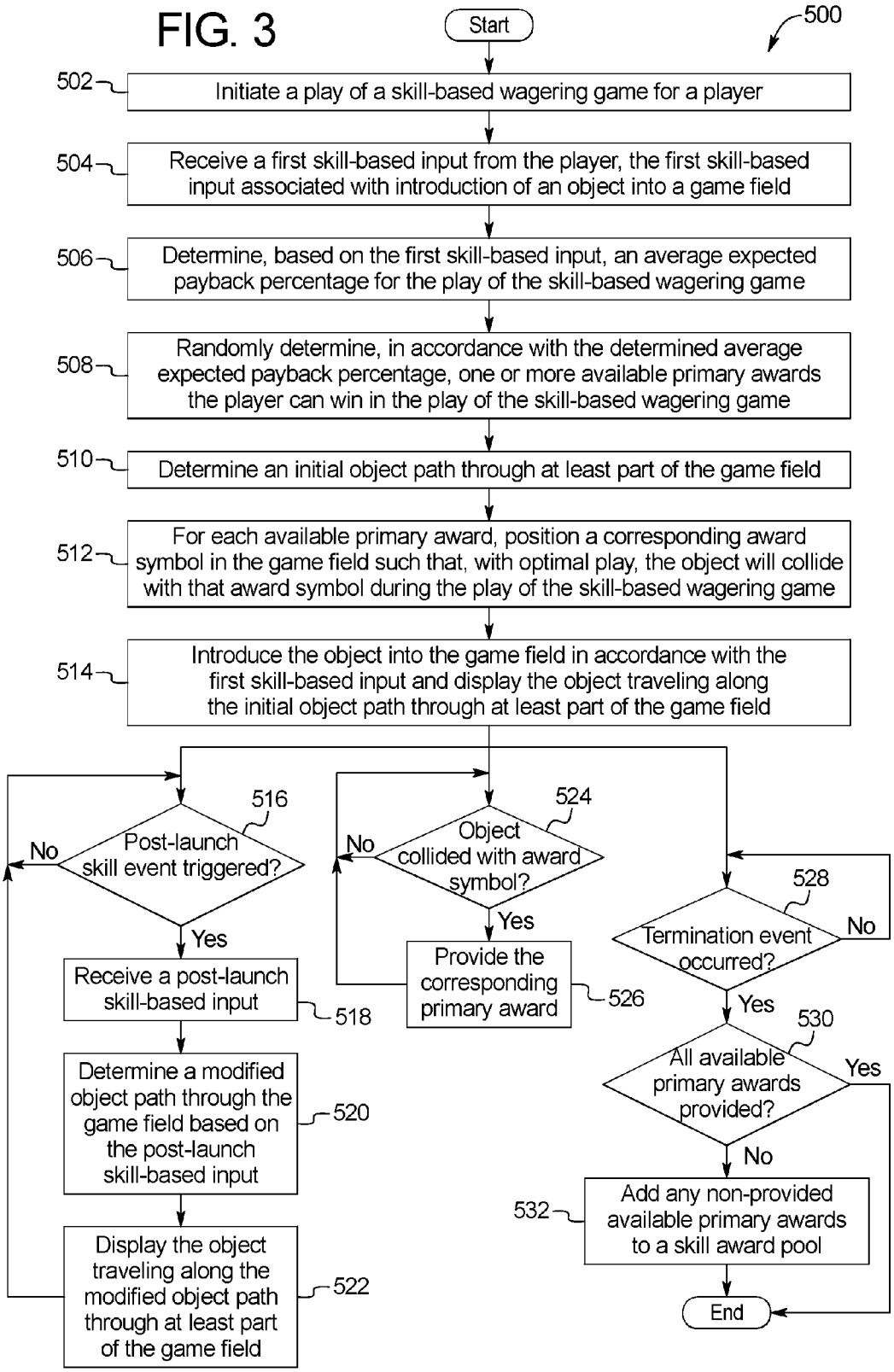
FIG. 3
Start
500
502
Initiate a play of a skill-based wagering game for a player
504
Receive a first skill-based input from the player, the first skill-based input associated with introduction of an object into a game field
506
Determine, based on the first skill-based input, an average expected payback percentage for the play of the skill-based wagering game
508
Randomly determine, in accordance with the determined average expected payback percentage, one or more available primary awards the player can win in the play of the skill-based wagering game
510
Determine an initial object path through at least part of the game field
512
For each available primary award, position a corresponding award symbol in the game field such that, with optimal play, the object will collide with that award symbol during the play of the skill-based wagering game
514
Introduce the object into the game field in accordance with the first skill-based input and display the object traveling along the initial object path through at least part of the game field
516
Post-launch skill event triggered?
No
Yes
Receive a post-launch skill-based input
518
Determine a modified object path through the game field based on the post-launch skill-based input
520
Display the object traveling along the modified object path through at least part of the game field
522
524
Object collided with award symbol?
No
Yes
Provide the corresponding primary award
526
528
Termination event occurred?
No
Yes
530
All available primary awards provided?
Yes
No
532
Add any non-provided available primary awards to a skill award pool
End

1000

GAMING SYSTEM AND METHOD PROVIDING A SKILL-BASED WAGERING GAME WITH AN AVERAGE EXPECTED PAYBACK PERCENTAGE DETERMINED BASED ON PLAYER SKILL LEVEL

PRIORITY

This application claims priority to and the benefit of U.S. Provisional Patent Application Ser. No. 62/398,977, filed Sep. 23, 2016, the entire contents of which are incorporated herein by reference.

COPYRIGHT NOTICE

A portion of this patent document contains material subject to copyright protection. The copyright owner does not object to photocopy reproduction of the patent document in the form it appears in the U.S. Patent and Trademark Office records, but otherwise reserves all copyright rights.

BACKGROUND

Electronic gaming machines (EGMs) operable to enable play of wagering games are well known. A typical wagering game includes a primary game, and certain wagering games also include a bonus game. Generally, these EGMs initiate a play of the primary game following: (1) receipt of a wager input (such as an actuation of a wager button) that indicates how much the player desires to wager; and/or (2) receipt of a game initiation input (such as an actuation of a play button). Many of these EGMs determine any primary awards for a wagered-on play of the primary game based on the outcome of the play of the primary game and the wager amount. Typically, the larger the wager amount, the larger the primary award (for the same outcome). Winning outcomes that are less likely to occur usually result in larger primary awards than winning outcomes that are more likely to occur. EGMs operable to enable play of a bonus game usually initiate a play of the bonus game upon an occurrence of a bonus triggering event. These EGMs determine any bonus awards for the play of the bonus game based on the outcome of the play of the bonus game and the wager amount.

SUMMARY

The gaming systems and methods of the present disclosure improve gaming technology in part by providing a skill-based wagering game and determining the average expected payback percentage (AEP %) for each play based on the player's skill level.

In various embodiments, the present disclosure provides a gaming system including a processor, and a memory device that stores a plurality of instructions that, when executed by the processor, cause the processor to: (a) receive a skill-based input from a player via an input device; (b) determine, based on the skill-based input, an average expected payback percentage from a set of average expected payback percentages ranging from a minimum average expected payback percentage to a maximum average expected payback percentage; (c) randomly determine, in accordance with the determined average expected payback percentage, one or more primary awards; (d) determine an object path through a game field; (e) for each of the one or more primary awards, position an award symbol corresponding to the primary award in the game field and along the object path; (f) cause a display device to display an object traveling along the determined object path through at least part of the game field and colliding with the one or more award symbols; and (g) provide the one or more primary awards.

In various other embodiments, the present disclosure provides a gaming system including a processor, and a memory device that stores a plurality of instructions that, when executed by the processor, cause the processor to: (a) receive a skill-based input from a player via an input device; (b) determine, based on the skill-based input, an average expected payback percentage from a set of average expected payback percentages ranging from a minimum average expected payback percentage to a maximum average expected payback percentage; (c) randomly determine, in accordance with the determined average expected payback percentage, one or more available primary awards; (d) determine an initial object path through at least part of a game field; (e) for each of the one or more primary awards, position an award symbol corresponding to the primary award in the game field, the award symbols positioned such that, with optimal play, the object will collide with all of the award symbols corresponding to the primary awards; (f) cause a display device to display an object traveling along the initial object path through at least part of the game field; (g) responsive to the object colliding with one of the award symbols, provide the corresponding award; and (h) responsive to a post-launch skill event being triggered: (1) receive another skill-based input from the player via the input device; (2) determine a modified object path through at least part of the game field based on the other skill-based input; and (3) cause the display device to display the object traveling along the modified object path through at least part of the game field.

Additional features and advantages are described in, and will be apparent from, the following Detailed Description and the Figures.

BRIEF DESCRIPTION OF THE FIGURES

FIG. 3 illustrates a flowchart of an example process or method 150 of operating a gaming system of the present disclosure to provide an example skill-based wagering game with post-introduction player interactivity and having an AEP % based on player skill level.

DETAILED DESCRIPTION

Figure 1:
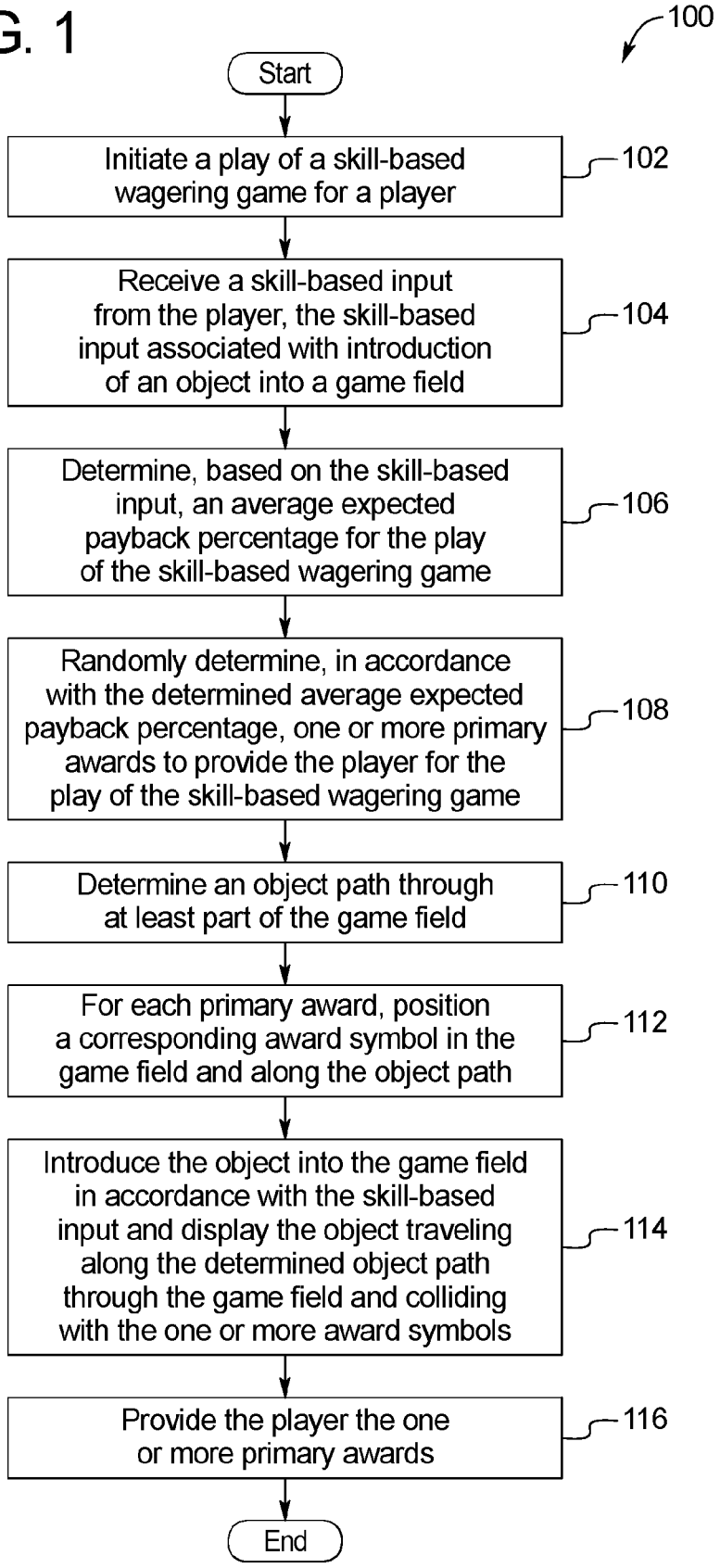
FIG. 1 illustrates a flowchart of an example process or method 150 of operating a gaming system of the present disclosure to provide an example skill-based wagering game without post-introduction player interactivity and having an AEP % based on player skill level.

The following initial description related to known EGMs is provided for better understanding of and context for the present disclosure.

For a particular wagering game, an EGM is usually configured to pay back, on average and over a large quantity of plays of that wagering game on that EGM, a certain percentage of the money players wager on the wagering game. The average percentage of money wagered that the EGM pays back to the players of the wagering game is typically called the average expected payback percentage (AEP %) or return to player (RTP) of the wagering game. The more plays of the wagering game played on that EGM, the more likely the actual payback percentage of the wagering game will approach its AEP %. For a typical EGM operable to provide a wagering game including a primary game and a bonus game, the AEP % of the wagering game includes: (1) the primary game AEP %; and (2) the bonus game AEP % (which takes into account the probability of triggering the bonus game). The primary game and bonus game AEP % are calculated separately, but together form the wagering game AEP %. Wagering game developers can modify the primary game and/or bonus game AEP % to offer different player experiences.

Most wagering gaming technology focuses on primary and bonus games of chance, not skill. Many primary and bonus games rely on a random (or pseudo-random) number generator to randomly determine an outcome for each play of the primary or bonus game (which in turn may be tied to an award via a paytable). Since these types of games require no special skills, an inexperienced player can perform just as well as an experienced player.

Skill-based games rely (at least partially) on player skill—not solely a random (or pseudo-random) number generator—to determine an outcome. Many people have grown accustomed to playing skill-based games on home video game consoles, smartphones, and tablet computers. While some would enjoy wagering on and playing skill-based games at EGMs, skill-based games have proven problematic in the gaming industry for game developers and gaming establishments. For instance, since a high-skill player can master a skill-based game, game developers may have to make the skill-based game relatively difficult or reduce the available awards to make the economics work. Increasing the difficulty level may alienate low-skill (or even medium-skill) players who won't be able to achieve a sufficient level of success while playing the skill-based game to justify continued play. And decreasing the available awards may alienate high-skill players who have no incentive to master the skill-based game due to the paltry awards. The players may not have good gaming experiences and may stop playing.

It is technically difficult to create gaming systems configured to operate wagering games that include a skill-based component that satisfy players of all skill levels.

The gaming systems and methods of the present disclosure improve gaming technology in part by providing a skill-based wagering game and determining the AEP % for each play based on the player's skill level.

Generally, in various embodiments, for a play of the skill-based wagering game, the gaming system receives a skill-based input from a player, derives a player skill level from the skill-based input, and determines an AEP % for the play based on the player skill level. The AEP % ranges from a minimum, nonzero AEP % to a maximum AEP %. The higher the player's skill level, the closer the AEP % is to the maximum AEP %, and vice-versa. The nonzero minimum AEP % appeals to low- and medium-skill players since they have a chance to win awards even if they perform poorly for a given play. High-skill players enjoy an advantage over their low- and medium-skill counterparts since they can use their high skill level to achieve comparatively higher AEP %'s, meaning they're more likely to win larger awards.

Generally, in various example embodiments, the skill-based wagering game involves introducing an object into a game field. An initial skill-based input (or inputs, in certain embodiments) is associated with—and in part controls—the introduction of the object into the game field.

In certain embodiments of the skill-based wagering game, the gaming system does not enable further skill-based inputs after the object has been introduced into the game field. Put differently, in these embodiments, the skill-based wagering game does not enable post-introduction player interactivity. In these embodiments, the gaming system determines the player's award(s) based on the initial skill-based input and one or more random determinations.

More specifically, in operation of one such embodiment, the gaming system initiates a play of a skill-based wagering game without post-introduction player interactivity and having an AEP % based on player skill level. The gaming system receives a skill-based input from the player. The skill-based input is associated with introduction of an object into a game field. The gaming system determines, based on the skill-based input, an AEP % for the play of the skill-based wagering game. For example, the gaming system determines, based on the skill-based input, the player's skill level (for this particular play) and uses that skill level to pick an AEP % from a set of AEP %'s ranging from a minimum AEP % to a maximum AEP %.

The gaming system randomly determines, based at least in part on the determined AEP %, one or more primary awards to provide the player for the play of the skill-based wagering game. The gaming system determines an object path through at least part of the game field, such as by using a suitable physics engine. The player's skill level influences the gaming system's determination of the object path. For each primary award, the gaming system positions a corresponding award symbol in the game field and along the determined object path. The gaming system introduces the object into the game field in accordance with the skill-based input and displays the object traveling along the determined object path through at least part of the game field and colliding with the one or more award symbols. The gaming system provides the player the one or more primary awards.

In other embodiments of the skill-based wagering game, the gaming system enables one or more additional skill-based inputs after the object has been introduced into the game field. Put differently, in these embodiments, the skill-based wagering game enables post-introduction player interactivity. In these embodiments, the gaming system determines the awards that the player can win during the play of the skill-based game based on the initial skill-based input. In these embodiments, the player must provide optimal subsequent skill-based inputs to win all of the determined awards.

More specifically, in operation of one such embodiment, the gaming system initiates a play of a skill-based wagering game with post-introduction player interactivity and having an AEP % based on player skill level. The gaming system receives a first skill-based input from the player. The first skill-based input is associated with introduction of an object into a game field. The gaming system determines, based on the first skill-based input, an AEP % for the play of the skill-based wagering game.

The gaming system randomly determines, based at least in part on the determined AEP %, one or more available primary awards the player can win in the play of the skill-based wagering game. The gaming system determines an initial object path through at least part of the game field, such as by using a suitable physics engine. The player's skill level influences the gaming system's determination of the initial object path. For each available primary award, the gaming system positions a corresponding award symbol in the game field such that, with optimal play, the object will collide with that award symbol during the play of the skill-based wagering game. The gaming system introduces the object into the game field in accordance with the skill-based input and displays the object traveling along the initial object path through at least part of the game field.

Responsive to triggering of a post-launch skill event, the gaming system receives a post-launch skill-based input. The gaming system determines a modified object path through at least part of the game field based on the post-launch skill-based input, such as by using a suitable physics engine. The gaming system displays the object traveling along the modified object path through at least part of the game field. Responsive to the object colliding with an award symbol, the gaming system provides the corresponding award.

In further embodiments of the skill-based wagering game, the gaming system does not use the initial skill-based input—which is associated with and in part controls introduction of the object into the game field—to determine the AEP %.

More specifically, in operation of one such embodiment, the gaming system initiates a play of a skill-based wagering game for a player, and displays a game field including one or more target objects, one or more award-generating objects, and one or more non-award-generating objects. The gaming system receives a skill-based input from the player. The skill-based input is associated with introduction of a player object into a game field. The gaming system introduces the player object into the game field in accordance with the skill-based input and displays the object moving within the game field based on output of a physics engine. The gaming system determines whether to remove any of the target objects based on the output of the physics engine, and removes any determined target objects. The gaming system determines whether to provide any awards associated with the one or more award-generating objects based on the output of the physics engine. The gaming system also determines whether a level-completion condition is satisfied and, if so, modifies any determined awards. The gaming system provides any determined awards or modified determined awards.

The gaming systems and methods of the present disclosure thus improve gaming technology at least in part by providing a skill-based wagering game and determining the AEP % for each play based on the player's skill level. Generally, for a play of the skill-based wagering game, the gaming system receives a skill-based input from a player, derives a player skill level from the skill-based input, and determines an AEP % for the play based on the player skill level. The AEP % ranges from a minimum, nonzero AEP % to a maximum AEP %. The higher the player's skill level, the closer the AEP % is to the maximum AEP %, and vice-versa. The nonzero minimum AEP % appeals to low- and medium-skill players since they have a chance to win awards even if they perform poorly for a given play. And high-skill players enjoy an advantage over their low- and medium-skill counterparts since they can use their high skill level to achieve comparatively higher AEP %'s, meaning they're more likely to win larger awards.

Generally, as mentioned above, in various embodiments, the skill-based wagering game involves introducing an object into a game field. An initial skill-based input is associated with—and in part controls—the introduction of the object into the game field. In certain embodiments of the skill-based wagering game, the gaming system does not enable further skill-based inputs after the object has been introduced into the game field. Put differently, in these embodiments, the skill-based wagering game does not enable post-introduction player interactivity. In these embodiments, the gaming system determines the player's award(s) based on the initial skill-based input and one or more random determinations. In other embodiments of the skill-based wagering game, the gaming system enables one or more additional skill-based inputs after the object has been introduced into the game field. Put differently, in these embodiments, the skill-based wagering game enables post-introduction player interactivity. In these embodiments, the gaming system determines the awards that the player can win during the play of the skill-based game based on the initial skill-based input. In these embodiments, the player must provide optimal subsequent skill-based inputs to win all of the determined awards.

FIGS. 1 and 2A to 2E show and describe example embodiments in which the skill-based wagering game does not enable post-introduction player interactivity and has an AEP % based on player skill level. FIGS. 3 and 4A to 4E show and describe example embodiments in which the skill-based wagering game enables post-introduction player interactivity and has an AEP % based on player skill level.

The rest of the Detailed Description uses numbered headings for clarity. These headings do not limit the scope of the present disclosure 1. Example Skill-Based Wagering Game without Post-Introduction Player Interactivity and Having an AEP % Based on Player Skill Level FIG. 1 illustrates a flowchart of an example process or method 100 of operating a gaming system of the present disclosure to provide an example skill-based wagering game without post-introduction player interactivity and having an AEP % based on player skill level. In various embodiments, a set of instructions stored in one or more memories and executed by one or more processors represents the process 100. Although the process 100 is described with reference to the flowchart shown in FIG. 1, many other processes of performing the acts associated with this illustrated process 100 may be employed. For example, the order of certain of the illustrated blocks or diamonds may be changed, certain of the illustrated blocks or diamonds may be optional, or certain of the illustrated blocks or diamonds may not be employed.

In operation of this example embodiment, the process 100 begins and the gaming system initiates a play of the skill-based wagering game for a player, as block 102 indicates. The gaming system receives a skill-based input from the player—such as an actuation of a button or other input device—as block 104 indicates. The skill-based input is associated with introduction of an object into a game field. Since this example skill-based wagering game doesn't enable post-introduction player interactivity, the gaming system doesn't enable any other skill-based inputs for this play. The gaming system determines, based on the skill-based input, an AEP % for the play of the skill-based wagering game, as block 106 indicates. For example, the gaming system determines, based on the skill-based input, the player's skill level (for this particular play) and uses that skill level to pick an AEP % from a set of AEP %'s ranging from a minimum AEP % to a maximum AEP %. Generally, in this example, the higher the player's skill level for a given play, the higher the AEP % the gaming system picks for that play.

The gaming system randomly determines, based at least in part on the determined AEP %, one or more primary awards to provide the player for the play of the skill-based wagering game, as block 108 indicates. The gaming system determines an object path through at least part of the game field, as block 110 indicates, such as by using a suitable physics engine. The player's skill level influences the gaming system's determination of the object path. For each primary award, the gaming system positions a corresponding award symbol in the game field and along the determined object path, as block 112 indicates. The gaming system introduces the object into the game field in accordance with the skill-based input and displays the object traveling along the determined object path through at least part of the game field and colliding with the one or more award symbols, as block 114 indicates. The gaming system provides the player the one or more primary awards, as block 116 indicates.

FIGS. 2A to 2E illustrate screen shots of one example embodiment of a gaming system operating an example primary skill-based wagering game without post-introduction player interactivity and having an AEP % based on player skill level. In this example embodiment, the skill-based wagering game is an object-launch game. As explained below, in this example embodiment, the player's skill-based input controls the object's launch angle, i.e., the angle at which an object launcher launches the object. This launch angle directly affects how high and how far the object will travel for the play of the skill-based wagering game.

The gaming system displays a gameplay area 200, an object area 300, and a map area 400.

The gaming system displays plays of the skill-based wagering game in the gameplay area 200, as described below and shown in FIGS. 2B-2E.

The gaming system displays a set of one or more objects available for the player to use for a play of the skill-based wagering game in the object area 300. When the set includes multiple objects, the gaming system enables the player to select which object of the set to use for a given play of the skill-based wagering game. As described below, different objects may have different characteristics that cause the objects to function differently during play. Here, only one object 302 is available for use and is displayed in the object area 300. The gaming system displays a box 310 around the object currently selected for use.

In this example embodiment, the skill-based wagering game is a multi-stage, multi-level game. That is, the skill-based wagering game includes multiple different stages, and each stage includes multiple different levels. The gaming system displays a map of the player's current stage in the map area 400. The map includes level symbols that represent the different levels of the stage and that are positioned along a path to show the player's progress through the stage. The gaming system also displays a current level indicator, which may be a generic indicator or a player-specific indicator such as the player's avatar, that indicates the level symbol corresponding to the player's current level. Certain stages also include mystery awards that the gaming system provides when the player reaches certain points along the path, and the gaming system displays corresponding mystery award symbols along the path. In this example embodiment, the player starts at Stage 1, Level 1, so the gaming system displays a Stage 1 map 410 that includes: (1) level symbols 411, 412, 413, 414, 416, 417, and 418 that respectively represent Levels 1, 2, 3, 4, 5, 6, and 7 of Stage 1; and (2) mystery award symbols 415 and 419 that represent mystery awards of Stage 1. The level and mystery award symbols 411-419 are positioned along a path (not labeled). A level indicator (here, an unlabeled arrow) indicates the level symbol 411 to indicate that player's current level is Level 1.

Initially, all levels of all stages except Stage 1, Level 1 are locked. The gaming system doesn't enable the player to play locked levels. To unlock a level, a level unlock condition for that level must be satisfied. In this example embodiment, a level unlock condition is satisfied for a locked level when either a level advancement condition or a level completion condition is satisfied in the immediately preceding level. In this example embodiment: (1) a level advancement condition is satisfied for a given level when the object is launched at least a first horizontal distance from the object launcher but less than a second horizontal distance from the object launcher; and (2) a level completion condition is satisfied for a given level when the object is launched the second distance (or in other embodiments, at least the second distance). When the level advancement condition is satisfied for a particular level for a play of the skill-based wagering game, the gaming system unlocks the next level (since the unlock condition is satisfied). When the level completion condition is satisfied for a particular level for a play of the skill-based wagering game, the gaming system unlocks the next level (since the unlock condition is satisfied) and provides a level completion award in addition to any primary award the player wins for the play. Once a level is unlocked, the gaming system enables the player to play that level again at any point.

The level advancement and level completion conditions may be any suitable conditions associated with the object's movement through the game field, such as (but not limited to) the object reaching a particular height, the object traveling through certain obstacles, the object colliding with a particular element or elements, the object reaching a particular area of the game field, the object reaching a particular (linear or rotational) velocity or speed, a damage level of the object reaching a particular level, the object interacting with a particular element or elements a designated quantity of times, and/or the object growing or shrinking to a designated size.

The gaming system also displays a credit meter 191 that displays the player's credit balance, a win meter 192 that displays any awards won for a play of the skill-based wagering game, and a bet meter 193 that displays the player's bet for a play of the skill-based wagering game.

Figure 2A:
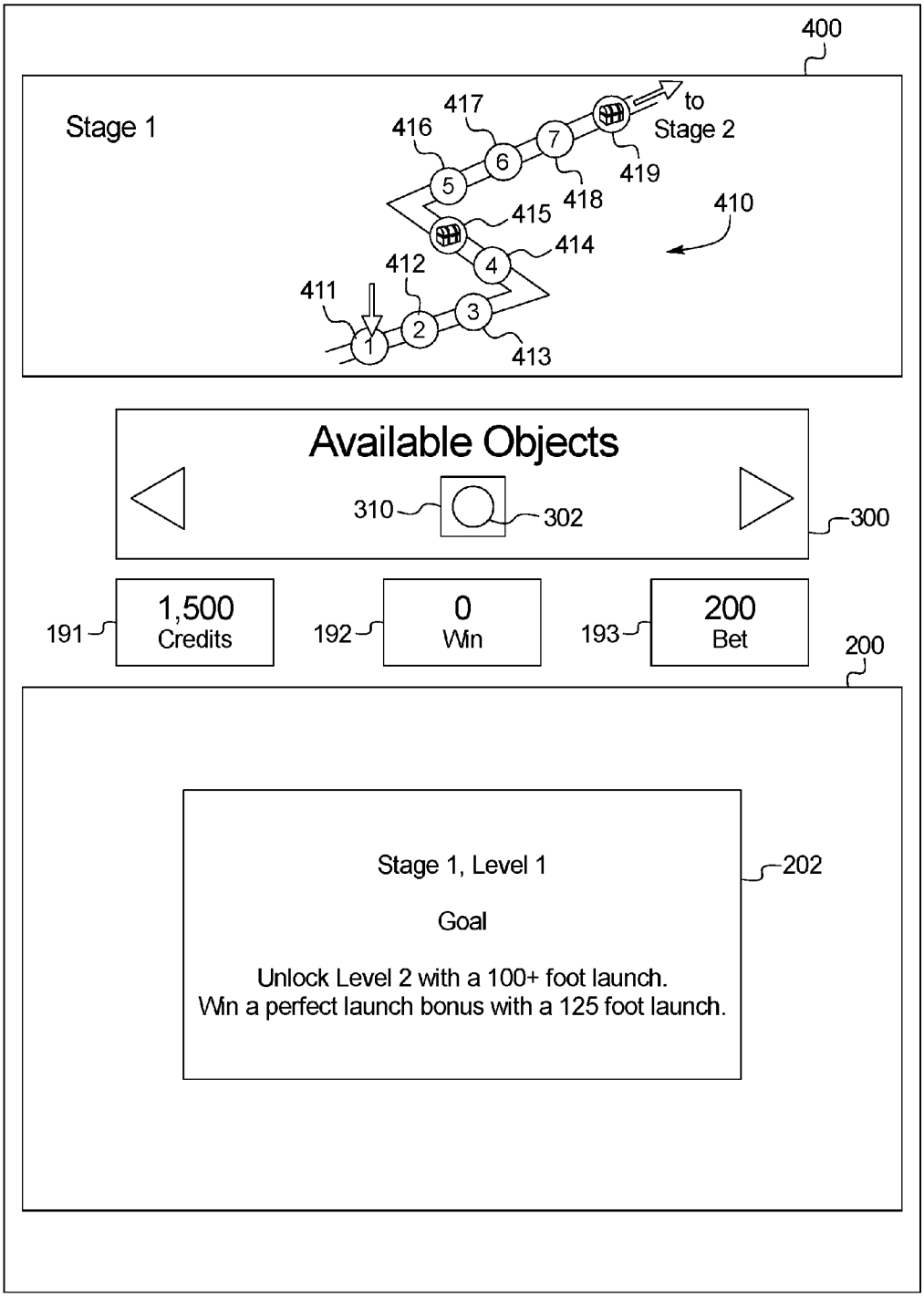
FIGS. 2A to 2E illustrate screen shots of one example embodiment of a gaming system operating an example primary skill-based wagering game without post-introduction player interactivity and having an AEP % based on player skill level.

Turning to FIG. 2A, at this point the gaming system has received an actuation of a START button (not shown), and in response initiated a play of the skill-based wagering game at Stage 1, Level 1 and placed 200 credit bet. Upon initiation of the play, the gaming system displays a pop-up box 202 that indicates: (1) how far the player must launch the object to satisfy the level advancement condition and unlock Stage 1, Level 2 (here, 100 feet); and (2) how far the player must launch the object to satisfy the level completion condition, win the level completion award, and unlock Stage 1, Level 2 (here, 125 feet).

Figure 2B:
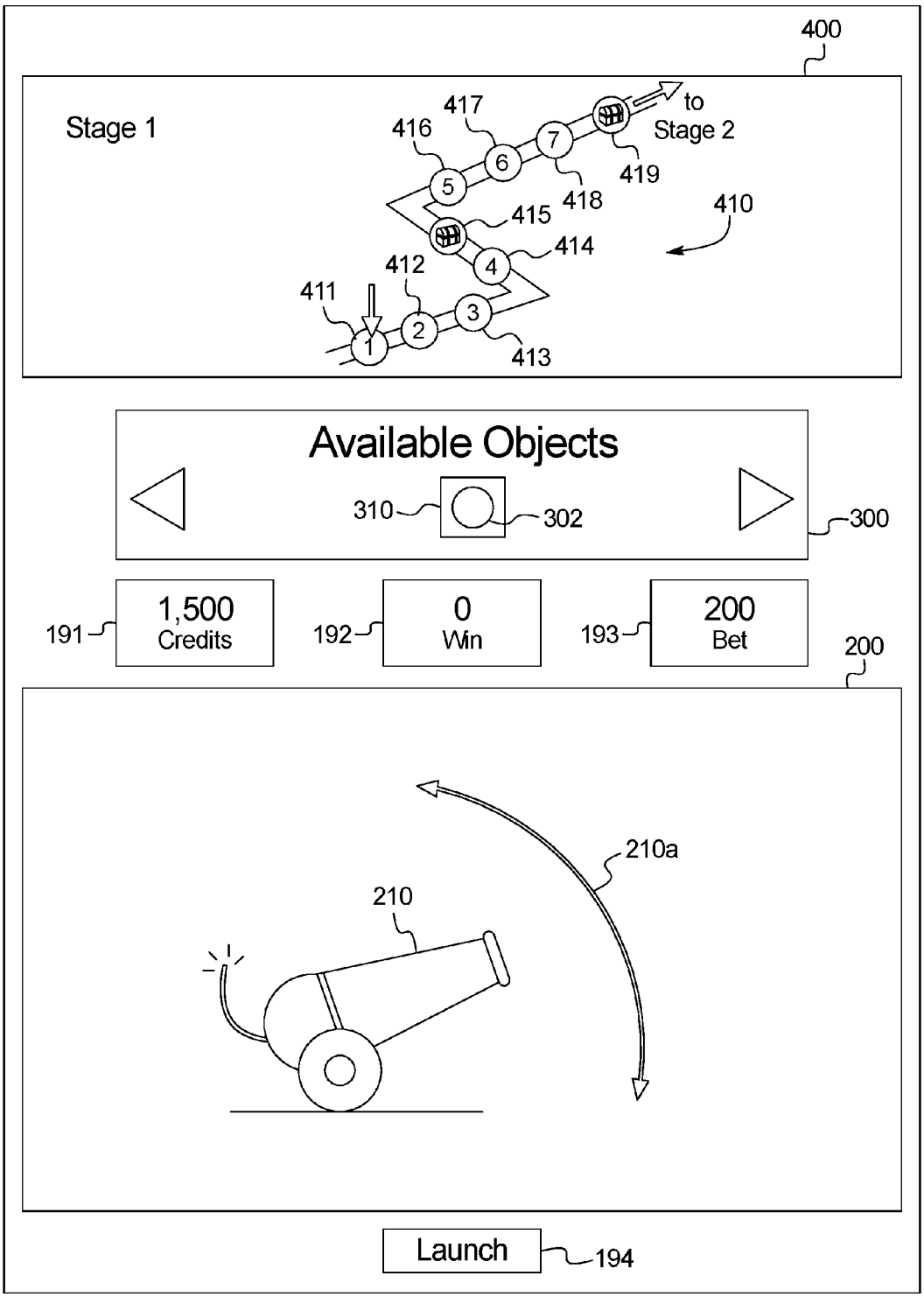

As shown in FIG. 2B, the gaming system displays an object launcher 210 from which the object 302 will be launched. The gaming system displays the object launcher 210 rotating up and down about a rotational axis near one end according to an arc 210*a* between forming a (minimum) 10 degree angle with the horizontal and a (maximum) 80 degree angle with the horizontal. The gaming system activates a LAUNCH button 194 and enables the player to provide a skill-based input by actuating the LAUNCH button 194. Responsive to receiving an actuation of the LAUNCH button 194, the gaming system stops rotating the object launcher 210 to set the launch angle of the object launcher 210, makes several different game characteristic determinations based on the launch angle (described below), and launches the object 302 from the object launcher 210. Put differently, the gaming system continuously varies the launch angle of the object launcher 210, and stops doing so to set the launch angle and launch the object 302 responsive to an actuation of the LAUNCH button 194. In this example embodiment, the gaming system doesn't display the game field within which the award symbols are displayed and through which the object travels before launch, though in other embodiments the gaming system does so.

The gaming system determines the following game characteristics based on the launch angle of the object launcher 210 (i.e., based on the player's skill-based input): (1) the AEP % of the play of the skill-based wagering game; (2) the probability of satisfying the level completion condition for the play of the skill-based wagering game; (3) the path the object will take post-launch; and (4) one or more primary awards the player will win for the play of the skill-based wagering game. Each is described below.

In this example embodiment, the gaming system determines the AEP % of the play of the skill-based wagering game based on the launch angle of the object launcher 210 via a suitable lookup table that matches launch angles to AEP %'s. Table 1 below is one such lookup table that matches AEP %'s to different launch angles for this example embodiment. In Stage 1, Level 1, a 45 degree launch angle is the optimal launch angle, and is associated with the highest AEP %. But even the worst launch angles (here, 10-14 degrees and 76-80 degrees) in this example embodiment are associated with a 50% AEP %. This means that even if a player performs so poorly as to actuate the LAUNCH button 194 at the worst possible time (correlating to one of the worst launch angles), the player still has a chance to win awards since the AEP % is nonzero.

TABLE 1

Example launch angle/AEP % lookup table

| Launch angle (degrees) | AEP % |
|---|---|
| 76-80 | 50% |
| 71-75 | 70% |

TABLE 1-continued

Example launch angle/AEP % lookup table

| Launch angle (degrees) | AEP % |
|---|---|
| 66-70 | 78% |
| 61-65 | 84% |
| 56-60 | 88% |
| 51-55 | 90% |
| 46-50 | 92% |
| 45 | 94% |
| 40-44 | 92% |
| 35-39 | 90% |
| 30-34 | 88% |
| 25-29 | 70% |
| 20-24 | 78% |
| 15-19 | 70% |
| 10-14 | 50% |

In this example embodiment, the gaming system also determines the probability of satisfying the level completion condition for the player of the skill-based wagering game based on the launch angle of the object launcher 210 using a suitable lookup table that matches launch angles to probabilities. Table 2 below is one such lookup table that matches probabilities of satisfying the level completion condition to different launch angles for this example embodiment. After determining the probability, the gaming system uses that probability to randomly determine whether the level completion condition will be satisfied for the play of the skill-based wagering game. Here, the probability of satisfying the level completion condition is nonzero for launch angles ranging from 25 degrees to 55 degrees and zero otherwise. The probability is the largest for the optimal 45 degree launch angle. This provides high-skill players an advantage over their low- and medium-skill counterparts in that their high skill level makes them more likely to satisfy the level completion condition (since they're more likely to set the launch angle at or near the 45 degree optimal launch angle). But an optimal launch angle doesn't guarantee satisfaction of the level completion condition.

TABLE 2

Example probability of satisfying the level completion condition/AEP % lookup table

| Launch angle (degrees) | Probability of satisfying the level completion condition |
|---|---|
| 76-80 | 0% |
| 71-75 | 0% |
| 66-70 | 0% |
| 61-65 | 0% |
| 56-60 | 0% |
| 51-55 | 1% |
| 46-50 | 5% |
| 45 | 7% |
| 40-44 | 5% |
| 35-39 | 2% |
| 30-34 | 1% |
| 25-29 | 1% |
| 20-24 | 0% |
| 15-19 | 0% |
| 10-14 | 0% |

In this example embodiment, the gaming system also determines the path the object will take post-launch—called the object path—based on the launch angle of the object launcher 210. In this embodiment, the gaming system uses a suitable physics engine to generate the object path. The gaming system provides a number of different inputs to the physics engine to enable it to determine the object path, such as the launch angle and whether the level completion condition will be satisfied. The determination of the object path also determines the horizontal object launch distance for the play of the skill-based wagering game. In certain embodiments, the gaming system employs a randomizer so identical launch angles could result in different paths and/or launch distances. For instance, each launch angle may be associated with multiple different object paths and associated distances generated by the physics engine, and the gaming system picks one for the play using a weighted table.

In this example embodiment, the gaming system also determines one or more primary awards to provide the player for the play of the skill-based wagering game in accordance with the AEP % for the play of the skill-based wagering game (which is determined based on the launch angle of the object launcher 210). More specifically, the gaming system generates a random number and uses a lookup table that matches numbers to different combinations of one or more primary awards to determine the one or more primary awards. Different AEP %'s are associated with different lookup tables, with the lookup tables being more lucrative as the AEP % increases. Table 3 below is a portion of an example of one such lookup table for a 94% AEP % and a 200 credit bet.

TABLE 3

Example partial random number/primary award(s) lookup table for 94% AEP % and a 200 credit bet

| Random number | Primary award(s) |
|---|---|
| 601-1,000 | 50 credit coin (×1) |
| 301-600 | 50 credit coin (×1), 100 credit mystery box (×1) |
| 101-300 | 50 credit coin (×2), 100 credit mystery box (×2) |
| 1-100 | 50 credit coin (×3), 150 credit mystery box (×1), 100 credit mystery box (×2) |

Once the gaming system determines the one or more primary awards to provide the player, for each of the one or more primary awards, the gaming system displays an award symbol corresponding to that primary award along the object path. During play, the gaming system provides the primary awards as the launched object travels along the object path and collides with the award symbols displayed along the object path. Since the gaming system positions the award symbols corresponding to the determined one or more primary awards along the object path, the player is guaranteed to win the one or more primary awards.

In this example embodiment, the launch angle of the object launcher 210 affects the volatility of the play of the skill-based wagering game, and particularly how many primary awards the gaming system determines to provide and their values. In this example embodiment, the gaming system provides a high-volatility experience—in that it is more likely to determine fewer awards having larger values—when the launch angle is greater than the optimal 45 degrees. And the gaming system provides a low-volatility experience—in that it is more likely to determine more awards having smaller values—when the launch angle is less than the optimal 45 degrees (though this may be switched in other embodiments). The player can time her actuation of the LAUNCH button 194 with this in mind. If the player prefers a high volatility experience, she'll time actuate the LAUNCH button 194 so if she misses the optimal 45 degree launch angle she will miss high (and get the high volatility experience). But if the player prefers a low volatility experience, she'll time actuate the LAUNCH button 194 so if she misses the optimal 45 degree launch angle she will miss low (and get the low volatility experience).

Figure 2C:
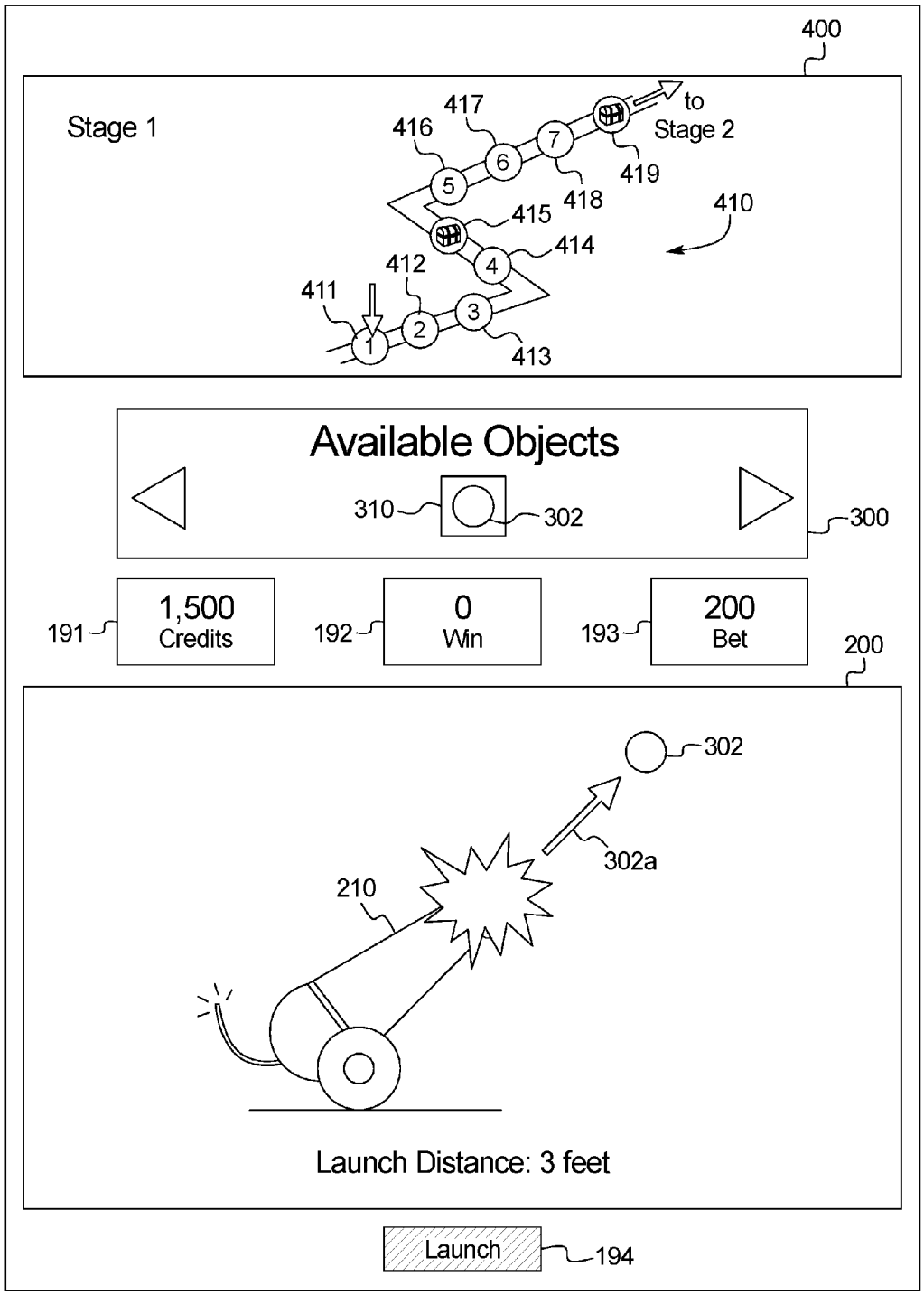

Turning to FIG. 2C, the gaming system receives an actuation of the LAUNCH button 194—i.e., a skill-based input—when the launch angle of the object launcher 210 is the optimal 45 degrees. Accordingly, the gaming system stops the object launcher 210 from rotating and sets the launch angle to 45 degrees.

Although not shown, the gaming system: (1) determines a 94% AEP % for this play of the skill-based wagering game based on the 45 degree launch angle (per Table 1 above); (2) determines a 7% probability of satisfying the level completion condition for this play of the skill-based wagering game based on the 45 degree launch angle (per Table 2 above); (3) randomly determines based on the 7% probability that the level completion condition will be satisfied for this play of the skill-based wagering game; (4) uses a physics engine to determine the object path the object 302 will follow post-launch based on the 45 degree launch angle and the fact that the level completion condition will be satisfied; and (5) randomly determines to provide primary awards in the form of three 50 credit coins, one 150 credit mystery box, and two 100 credit mystery boxes (per Table 3 above).

Figure 2D:
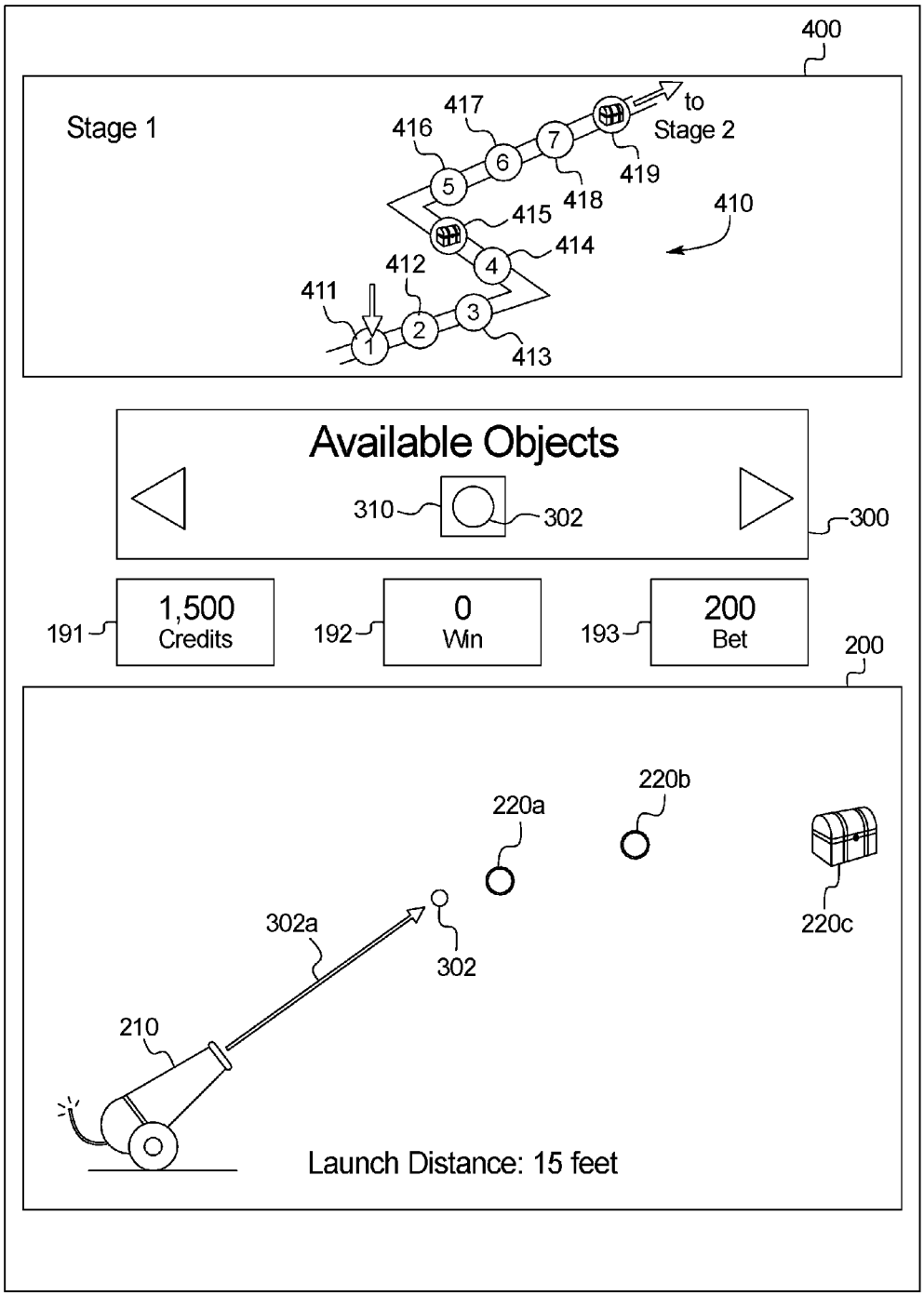
Figure 2E:
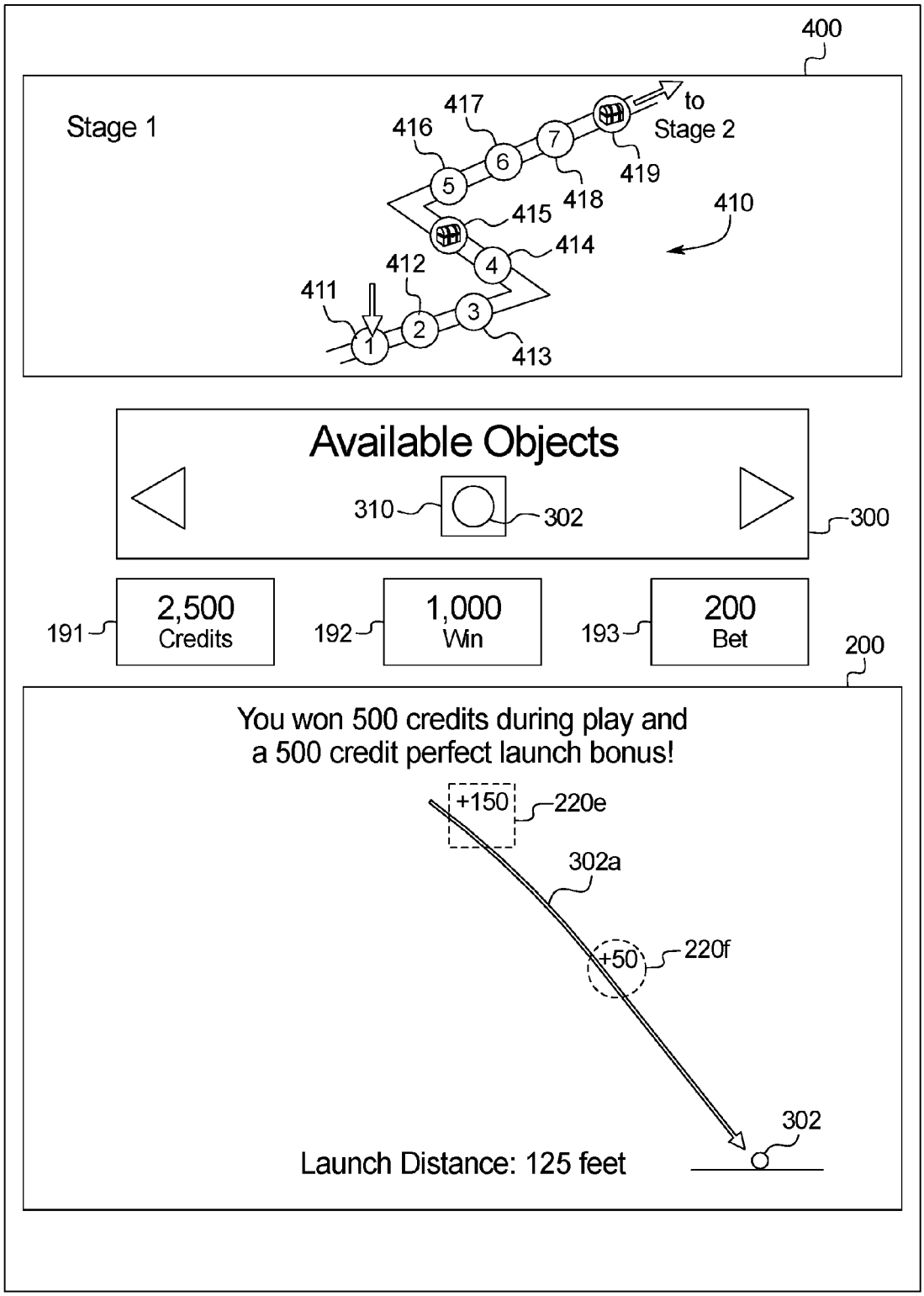

Returning to FIG. 2C, the gaming system launches the object 302 along the object path 302*a*. The gaming system displays a launch distance meter (not labeled) that indicates how far the object 302 has traveled from the object launcher 210. FIG. 2D shows the object 302 at a later point in time post-launch and following the object path 302*a*. At this point, 50 credit coins 220*a* and 220*b* and 100 credit mystery box 220*b* (i.e., award symbols) are displayed along the object path 302*a*. Although not shown, the object 302 will eventually collide with these award symbols and the gaming system will provide their corresponding awards. FIG. 2E shows the object 302 as it reaches the end of the object path 302*a* 125 feet from the object launcher 210. 150 credit mystery box 220*e* and 50 credit coin 220*f*, award symbols with which the object 302 collided, are shown in phantom. Since this play of the skill-based wagering game satisfied the level completion condition because the launch distance was 125 feet, the gaming system provides a 500 credit level completion award in addition to the 500 credit primary award and unlocks Stage 1, Level 2.

In certain embodiments, the gaming system uses the skill-based input to determine a base AEP %, then determines, using at least one random determination, the actual AEP % of the play of the game from a range of AEP % including that base value. For instance, a 45 degree launch angle may be associated with a base AEP % of 94%, and the gaming system determines the actual AEP % for the play from a range of 92% to 96% based on a weighted lookup table. This introduces another element of randomness to the skill-based wagering game. The potential difference in AEP % from game-to-game could manifest itself in a variety of ways, such as changing wind direction or different object characteristics.

In certain embodiments, rather than placing an award symbol on the object path, the gaming system displays the award symbol off of, but near, the object path. In these embodiments, the object automatically moves or modifies itself to contact the award symbol. This increases player anticipation, as players are not sure whether the object will collide with certain off-the-path award symbols. In various embodiments, the gaming system displays award symbols that the object cannot (and will not) contact to heighted player excitement and anticipation, such as to create "near-misses."

2. Example Skill-Based Wagering Game with Post-Introduction Player Interactivity and Having an AEP % Based on Player Skill Level FIG. 3 illustrates a flowchart of an example process or method 500 of operating a gaming system of the present disclosure to provide an example skill-based wagering game with post-introduction player interactivity and having an AEP % based on player skill level. In various embodiments, a set of instructions stored in one or more memories and executed by one or more processors represents the process 500. Although the process 500 is described with reference to the flowchart shown in FIG. 3, many other processes of performing the acts associated with this illustrated process 500 may be employed. For example, the order of certain of the illustrated blocks or diamonds may be changed, certain of the illustrated blocks or diamonds may be optional, or certain of the illustrated blocks or diamonds may not be employed.

In operation of this example embodiment, the process 500 begins and the gaming system initiates a play of the skill-based wagering game for a player, as block 502 indicates. The gaming system receives a first skill-based input from the player—such as an actuation of a button or other input device—as block 504 indicates. The first skill-based input is associated with introduction of an object into a game field. The gaming system determines, based on the first skill-based input, an AEP % for the play of the skill-based wagering game, as block 506 indicates. For example, the gaming system determines, based on the first skill-based input, the player's skill level (for this particular play), and uses that skill level to pick an AEP % from a set of AEP %'s ranging from a minimum AEP % to a maximum AEP %. Generally, in this example, the higher the player's skill level for a given play, the higher the AEP % the gaming system picks for that play.

The gaming system randomly determines, based at least in part on the determined AEP %, one or more available primary awards the player can win in the play of the skill-based wagering game, as block 508 indicates. Unlike the embodiment described above with respect to FIGS. 1-2E, in most instances the player is not automatically guaranteed to win the one or more available primary awards; rather, the player must play the skill-based wagering game optimally (e.g., by providing one or more optimal post-launch skill-based inputs) to win the one or more available primary awards.

The gaming system determines an initial object path through at least part of the game field, as block 510 indicates, such as by using a suitable physics engine. The player's skill level influences the gaming system's determination of the initial object path. For each available primary award, the gaming system positions a corresponding award symbol in the game field such that, with optimal play, the object will collide with that award symbol during the play of the skill-based wagering game, as block 512 indicates. The gaming system introduces the object into the game field in accordance with the skill-based input and displays the object traveling along the initial object path through at least part of the game field, as block 514 indicates.

Afterwards, the gaming system monitors for: (1) triggering of a post-launch skill event, as diamond 516 indicates; (2) the object colliding with an award symbol, as diamond 524 indicates; and (3) an occurrence of a termination event, as diamond 528 indicates.

Responsive to triggering of a post-launch skill event, the gaming system receives a post-launch skill-based input (or multiple post-launch skill-based inputs), as block 518 indicates. The gaming system determines a modified object path through at least part of the game field based on the post-launch skill-based input, as block 520 indicates, such as by using a suitable physics engine. The gaming system displays the object traveling along the modified object path through at least part of the game field, as block 522 indicates.

Responsive to the object colliding with an award symbol, the gaming system provides the corresponding award, as block 526 indicates.

Responsive to an occurrence of the termination event, the gaming system determines whether all of the available primary awards were provided to the player, as diamond 530 indicates. If the gaming system determines at diamond 530 that all of the available primary awards were provided to the player, the process 500 ends. If not, the gaming system adds any non-provided available primary awards to a skill-award pool, as block 532 indicates, and the process 500 ends. The gaming system may use the skill award pool to fund skill-based awards for later plays of the skill-based wagering game.

FIGS. 4A to 4E illustrate screen shots of one example embodiment of a gaming system operating an example primary skill-based wagering game with post-introduction player interactivity and having an AEP % based on player skill level. In this example embodiment, the skill-based wagering game is an object-launch game. As explained below, in this example embodiment, the player's initial skill-based input controls the object's launch angle, i.e., the angle at which an object launcher launches the object. This launch angle directly affects how high and how far the object will travel for the play of the skill-based wagering game. Later skill-based inputs (if applicable) modify the object's path of travel.

Continuing with the example described above with respect to FIGS. 2A to 2E, at this point the player has progressed to Stage 2, Level 1. All levels in Stage 2 provide plays of the skill-based wagering game with post-introduction player interactivity and having an AEP % based on player skill level. Accordingly, the gaming system displays a Stage 2 map 420 that includes: (1) level symbols 421, 422, 423, 424, 426, 427, and 428 that respectively represent Levels 1, 2, 3, 4, 5, 6, and 7 of Stage 2; and (2) mystery award symbols 425 and 429 that represent mystery awards of Stage 2. The level and mystery award symbols 421-429 are positioned along a path (not labeled). A level indicator (here, an unlabeled arrow) indicates the level symbol 421 to indicate that player's current level is Level 1.

In this example embodiment: (1) the level advancement condition is satisfied for Level 1 when the object is launched over a particular obstacle (here, a mountain); and (2) a level completion condition is satisfied for Level 1 when the object is launched through a ring and over the obstacle. When the level advancement condition is satisfied for Level 1, the gaming system unlocks Level 2 (since the unlock condition is satisfied). When the level completion condition is satisfied for Level 1, the gaming system unlocks Level 2 (since the unlock condition is satisfied) and provides a level completion award in addition to any primary award the player wins for the play.

Figure 4A:
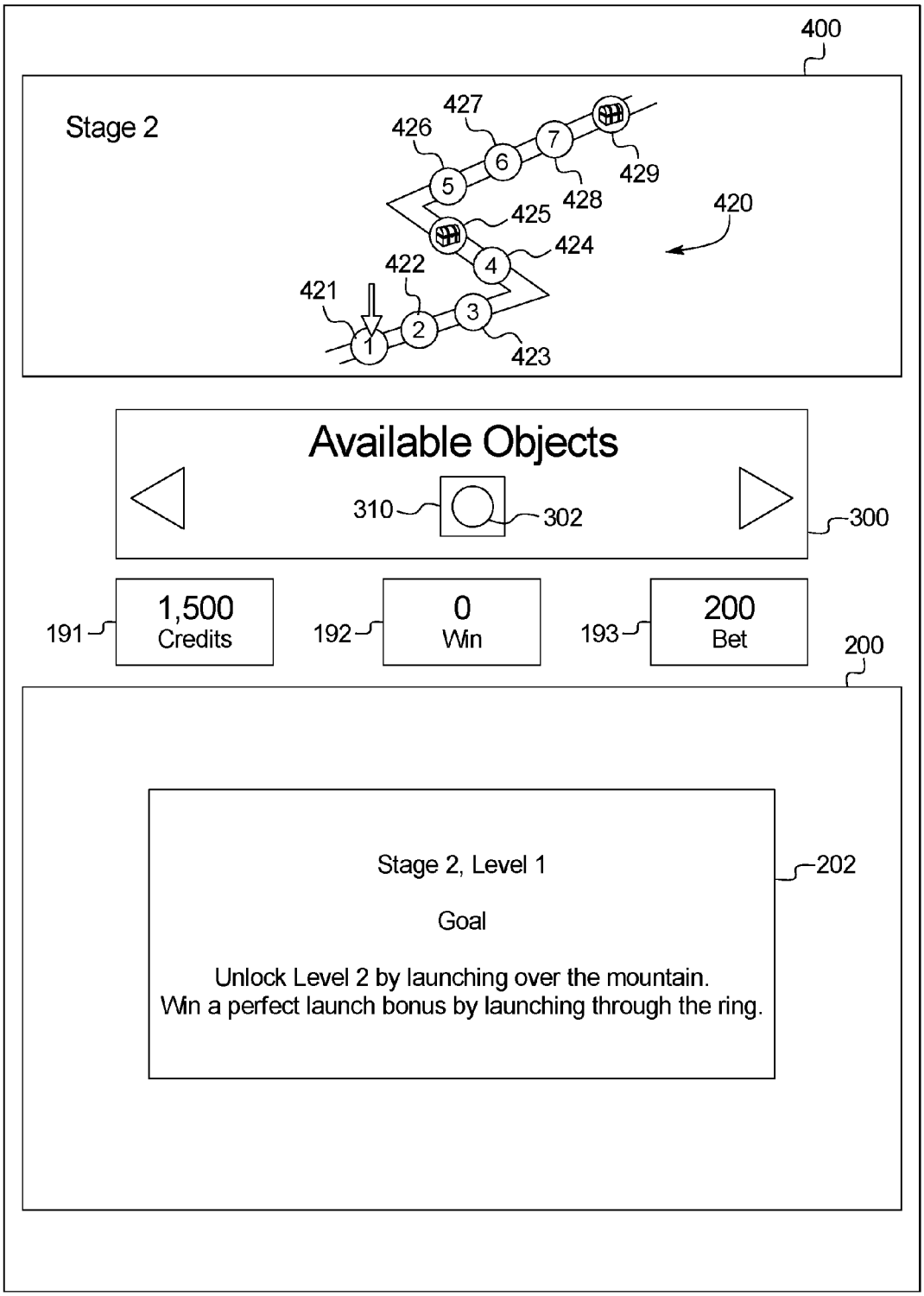
FIGS. 4A to 4E illustrate screen shots of one example embodiment of a gaming system operating an example primary skill-based wagering game with post-introduction player interactivity and having an AEP % based on player skill level.

Turning to FIG. 4A, at this point the gaming system has received an actuation of a START button (not shown), and in response initiated a play of the skill-based wagering game at Stage 2, Level 1 and placed 200 credit bet. Upon initiation of the play, the gaming system displays a pop-up box 202 that indicates: (1) that the player must launch the object over the mountain to satisfy the level advancement condition and unlock Stage 2, Level 2; and (2) that the player must launch the object over the mountain and through a ring to unlock Stage 2, Level 2.

Figure 4B:
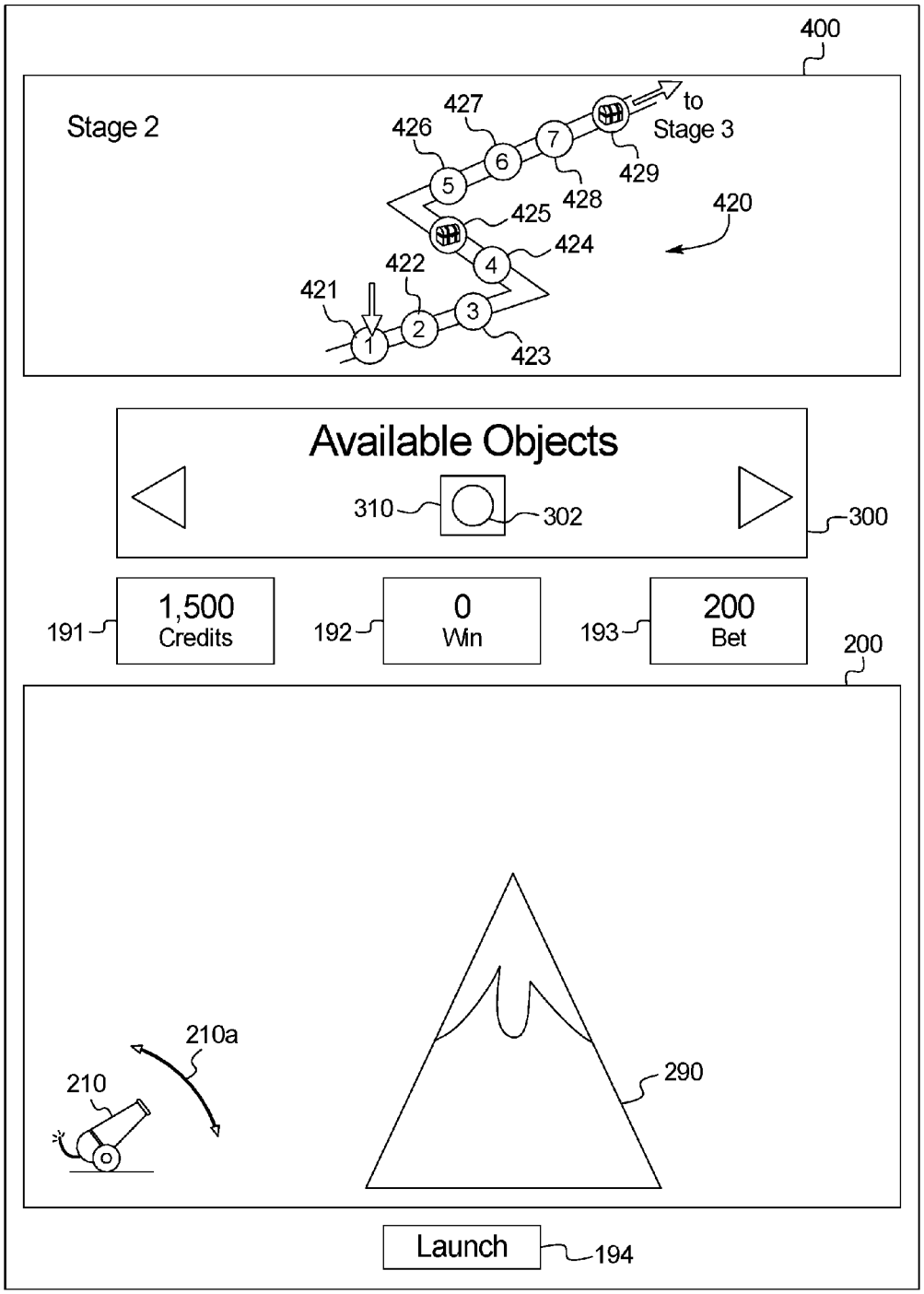

As shown in FIG. 4B, the gaming system displays an object launcher 210 from which the object 302 will be launched. The gaming system displays the object launcher 210 rotating up and down about a rotational axis near one end according to an arc 210*a* between forming a (minimum) 10 degree angle with the horizontal and a (maximum) 80 degree angle with the horizontal. The gaming system activates a LAUNCH button 194 and enables the player to provide a skill-based input by actuating the LAUNCH button 194. Responsive to receiving an actuation of the LAUNCH button 194, the gaming system stops rotating the object launcher 210 to set the launch angle of the object launcher 210, makes several different game characteristic determinations based on the launch angle (described below), and launches the object 302 from the object launcher 210. Put differently, the gaming system continuously varies the launch angle of the object launcher 210, and stops doing so to set the launch angle and launch the object 302 responsive to an actuation of the LAUNCH button 194. The gaming system also displays the mountain 290 over which the player must launch the object to satisfy the level advancement condition and the ring 292 through which the player must launch the object to satisfy the level completion condition. This help the player plan her initial launch angle.

The gaming system determines the following game characteristics based on the launch angle of the object launcher 210 (i.e., based on the player's skill-based input): (1) the AEP % of the play of the skill-based wagering game; (2) the initial path the object will take post-launch; (3) one or more available primary awards the player can win in the play of the skill-based wagering game; and (4) for each available primary award, where to position a corresponding award symbol within the game field such that, with optimal play, the object will collide with that award symbol during the play of the skill-based wagering game. Each is described below.

In this example embodiment, the gaming system determines the AEP % of the play of the skill-based wagering game based on the launch angle of the object launcher 210 via a suitable lookup table that matches launch angles to AEP %'s. Table 1 above is one such lookup table that matches AEP %'s to different launch angles for this example embodiment.

In this example embodiment, the gaming system also determines the initial path the object will take post-launch—called the initial object path—based on the launch angle of the object launcher 210. In this embodiment, the gaming system uses a suitable physics engine to generate the object path. The gaming system provides a number of different inputs to the physics engine to enable it to determine the initial object path, such as the launch angle.

In this example embodiment, the gaming system also determines one or more available primary awards the player can win in the play of the skill-based wagering game in accordance with the AEP % for the play of the skill-based wagering game (which is determined based on the launch angle of the object launcher 210). More specifically, the gaming system generates a random number and uses a lookup table that matches numbers to different combinations of one or more available primary awards to determine the one or more available primary awards. Different AEP %'s are associated with different lookup tables, with the lookup tables being more lucrative as the AEP % increases. Table 3 above is a portion of an example of one such lookup table for a 94% AEP % and a 200 credit bet.

Once the gaming system determines the one or more available primary awards, for each of the one or more available primary awards, the gaming system determines where to position a corresponding award symbol within the game field such that, with optimal play, the object will collide with that award symbol during the play of the skill-based wagering game. The gaming system does so in any suitable manner taking into consideration of a variety of different factors, such as the object itself, the launch angle, and any post-launch skill events that will be triggered.

During play, the gaming system triggers at least one post-launch skill event. The gaming system may trigger a post-launch skill event in any suitable manner, such as randomly, based on the player's initial skill-based input, based on the positions of the award symbols, based on player interaction, based on the player choosing to use an object's feature or ability, based on boosts or game enhancements at a specific time to change the state of the game (e.g., inverting gravity for a limited time or changing other environmental variables in the game as well as adding modifiers). In certain embodiments, the gaming system may not trigger a post-launch skill event. In certain embodiments, the closer to optimal the launch level, the more likely the gaming system will trigger a post-launch skill event. Optimal play of all post-launch skill events guarantees the object will contact all of the award symbols associated with the determined one or more primary awards, meaning the player will win all of the available awards for the play of the skill-based wagering game. Note that with optimal play the object will not contact each and every displayed award symbol, just those associated with the determined one or more primary awards.

Figure 4C:
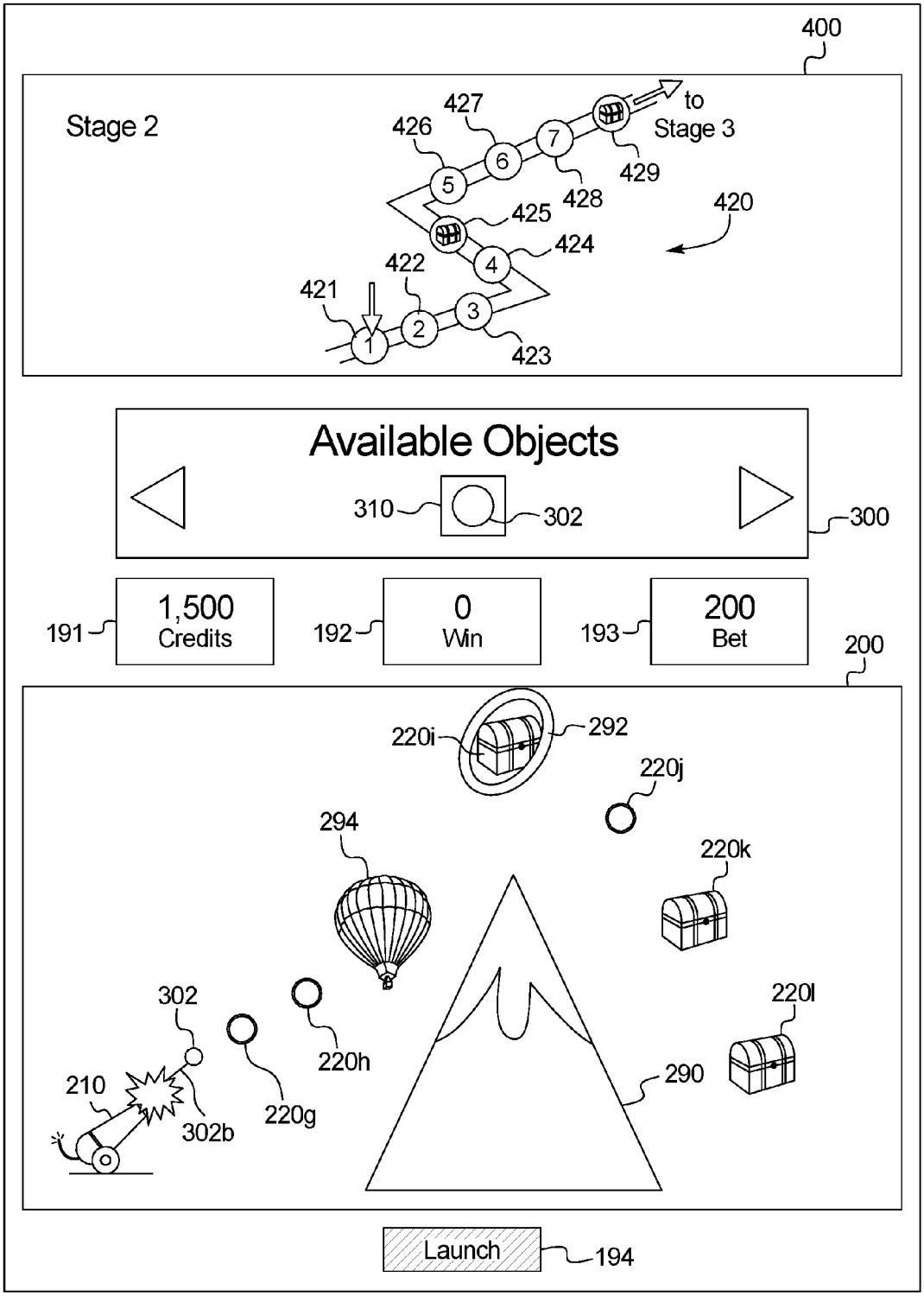

Turning to FIG. 4C, the gaming system receives an actuation of the LAUNCH button 194—i.e., a skill-based input—when the launch angle of the object launcher 210 is the optimal 45 degrees. Accordingly, the gaming system stops the object launcher 210 from rotating and sets the launch angle to 45 degrees.

Although not shown, the gaming system: (1) determines a 94% AEP % for this play of the skill-based wagering game based on the 45 degree launch angle (per Table 1 above); (2) uses a physics engine to determine the initial object path the object 302 will follow post-launch based on the 45 degree launch angle; (3) randomly determines available primary awards in the form of three 50 credit coins, one 150 credit mystery box, and two 100 credit mystery boxes (per Table 3 above); and (4) positions award symbols 220*g*-220*l* corresponding to the available primary awards in the game field such that, with optimal play, the object will collide with all of those award symbols during play.

Figure 4D:
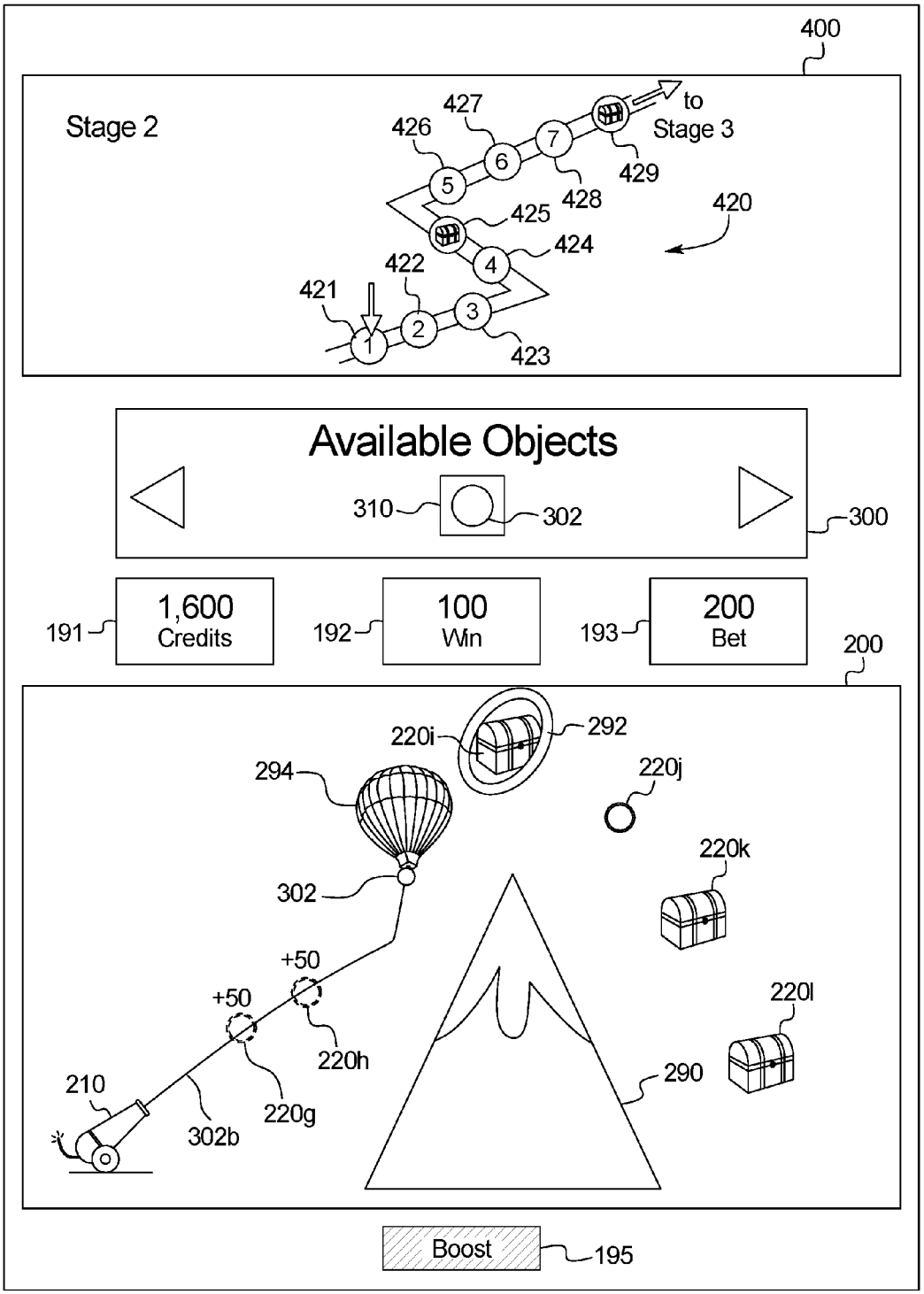
Figure 4E:
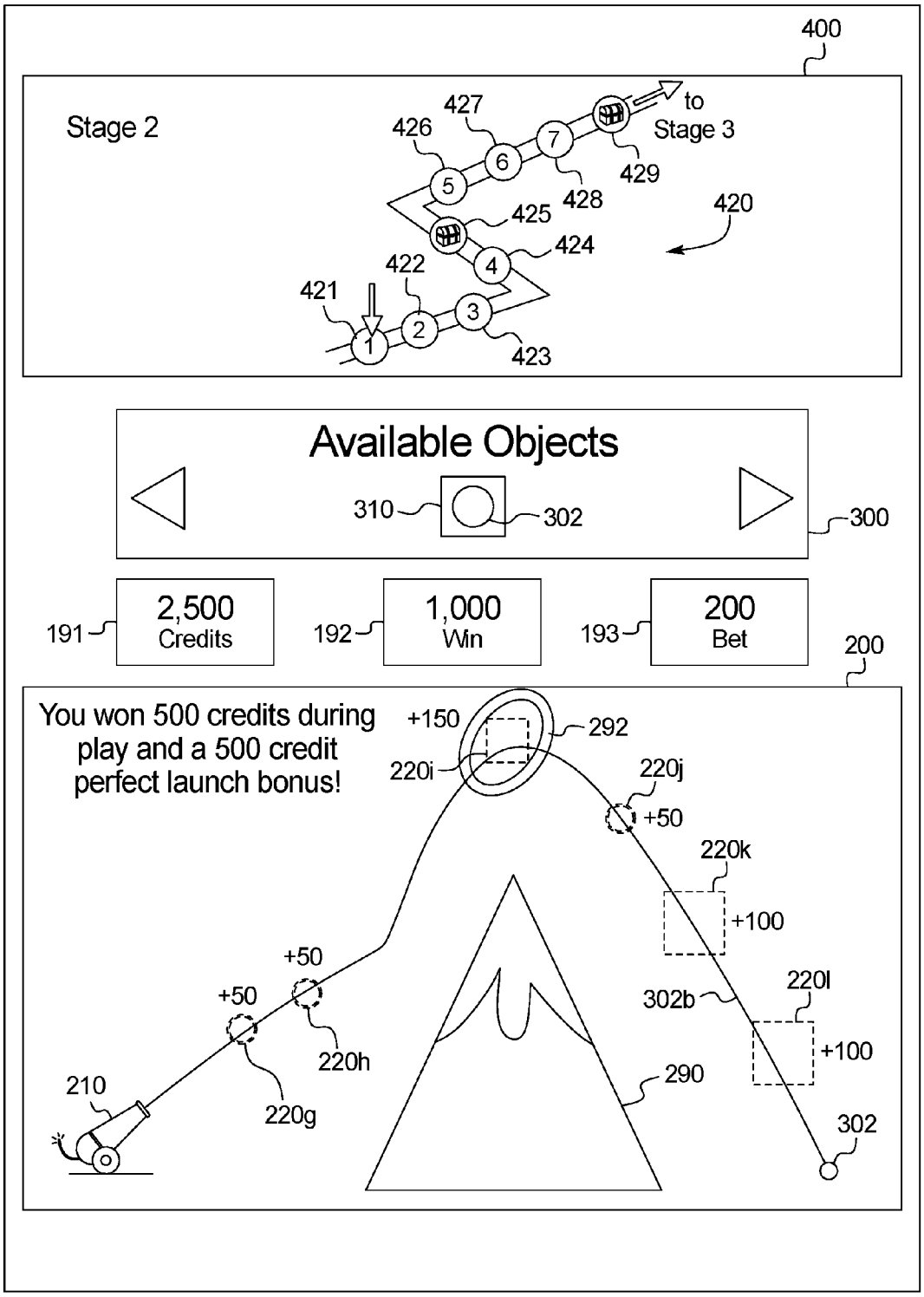

Returning to FIG. 4C, the gaming system launches the object 302 along the initial object path 302*b*. FIG. 4D shows the object 302 at a later point in time post-launch after it's contacted a balloon 294, which triggers the post-launch skill event in this example embodiment. After contacting the balloon, the player must repeatedly actuate a BOOST button 195 as quickly as possible, since the faster the player does so, the quicker the balloon carries the object 302 upward and toward the ring 292. FIG. 4E shows the object 302 after it has come to a stop and reached the end of the object path 302*b*. The player provided an optimal post-launch skill-based input—i.e., actuated the BOOST button 195 at a fast enough rate—so the object contacted all of the award symbols 220*g*-220*l* and the gaming system provides a 500 credit primary award. The level completion condition is satisfied since the object 302 traveled over the mountain 290 and through the ring 292. Accordingly, the gaming system provides a 500 credit level completion award in addition to the 500 credit primary award and unlocks Stage 2, Level 2.

In certain embodiment, the gaming system may re-position an award symbol that the object missed to give the player another opportunity to win the corresponding award. In one embodiment, the gaming system moves the award symbol onto the object path (in which case the player is guaranteed to win the corresponding award unless she modifies the object path via post-launch interactivity) or not onto the object path.

In certain embodiments, the player can satisfy the level completion condition only if the gaming system randomly determines to enable the player to do so. That is, in these embodiments, if the gaming system doesn't determine to enable the player to satisfy the level completion condition, even with optimal play the player cannot satisfy the level completion condition. The gaming system does so in a manner similar to the way described above with respect to FIGS. 1-2E. For instance, the gaming system determines, based on the launch angle, the probability of enabling the player to satisfy the level completion condition. If that probability is nonzero, the gaming system randomly determines, based on that probability, whether to enable the player to satisfy the level completion condition. If so, the gaming system enables the player to satisfy the level completion condition, which the player may do through optimal or nearly-optimal play.

Figure 5:
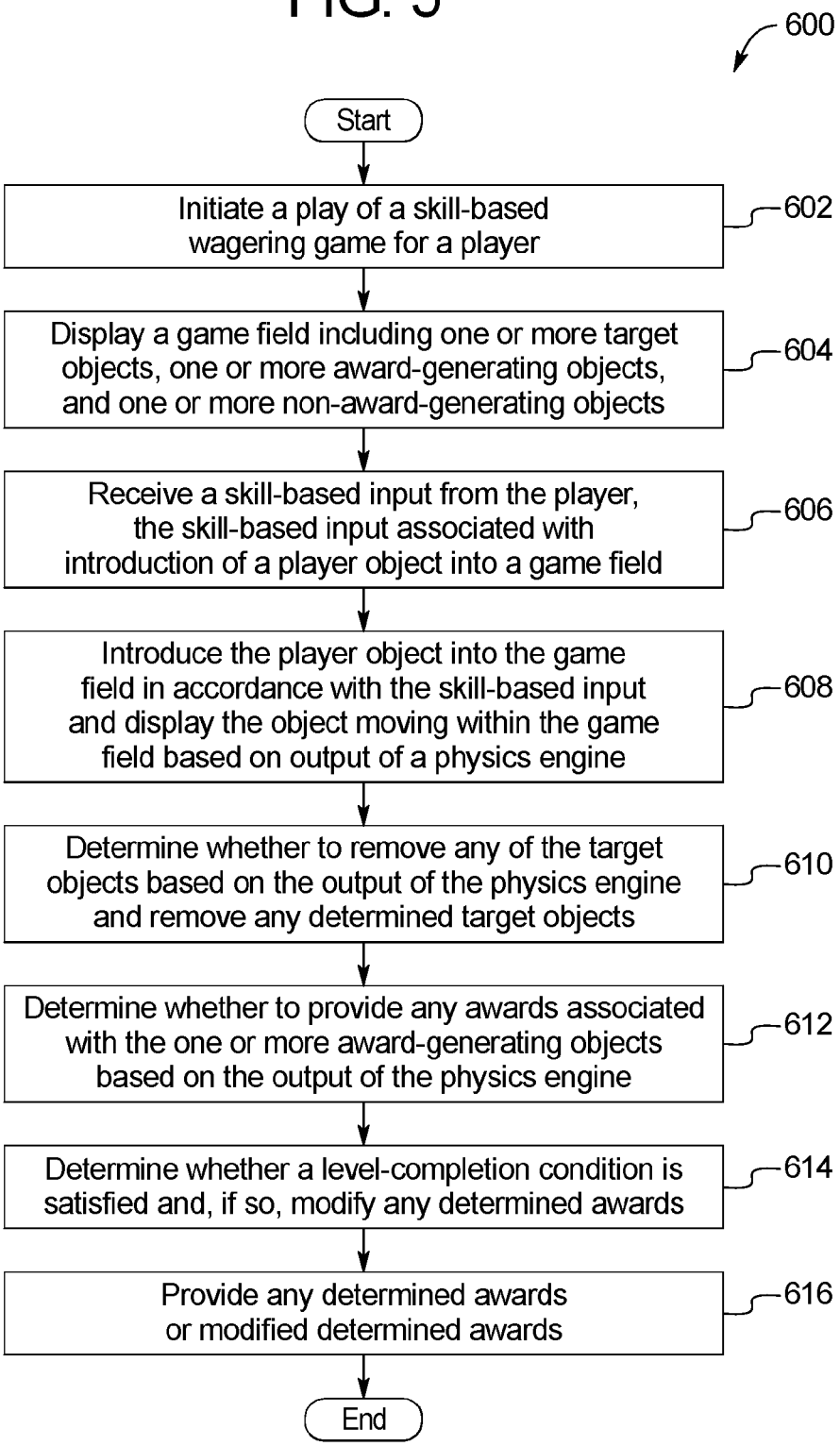
FIG. 5 illustrates a flowchart of an example process or method 600 of operating a gaming system of the present disclosure to provide an example skill-based wagering game not having an AEP % based on player skill level.

3. Example Skill-Based Wagering Game not Having an AEP % Based on Player Skill Level FIG. 5 illustrates a flowchart of an example process or method 600 of operating a gaming system of the present disclosure to provide an example skill-based wagering game not having an AEP % based on player skill level. In various embodiments, a set of instructions stored in one or more memories and executed by one or more processors represents the process 600. Although the process 600 is described with reference to the flowchart shown in FIG. 5, many other processes of performing the acts associated with this illustrated process 600 may be employed. For example, the order of certain of the illustrated blocks or diamonds may be changed, certain of the illustrated blocks or diamonds may be optional, or certain of the illustrated blocks or diamonds may not be employed.

In operation of this example embodiment, the process 600 begins and the gaming system initiates a play of the skill-based wagering game for a player, as block 602 indicates. The gaming system displays a game field including one or more target objects, one or more award-generating objects, and one or more non-award-generating objects, as block 604 indicates. The gaming system receives a skill-based input from the player—such as an actuation of a button or other input device—as block 606 indicates. The skill-based input is associated with introduction of an object into a game field. The gaming system introduces the object into the game field in accordance with the skill-based input and displays the object moving within the game field based on output of a physics engine, as block 608 indicates.

The gaming system determines whether to remove any of the target objects based on the output of the physics engine and removes any determined target objects, as block 610 indicates. The gaming system determines whether to provide any awards associated with the one or more award-generating objects based on the output of the physics engine, as block 612 indicates. The gaming system determines whether a level-completion condition is satisfied and, if so, modifies any determined awards, as block 614 indicates. The gaming system provides any determined awards or modified determined awards, as block 616 indicates.

FIGS. 6A to 6E illustrate screen shots of one example embodiment of a gaming system operating an example primary skill-based wagering game not having an AEP % based on player skill level. In this example embodiment, the skill-based wagering game is an object-launch game. As explained below, in this example embodiment, the player's initial skill-based input controls the object's launch angle, i.e., the angle at which an object launcher launches the object.

Continuing with the example described above with respect to FIGS. 2A to 2E and 4A to 4E, at this point the player has progressed to Stage 3, Level 1. All levels in Stage 3 provide plays of the skill-based wagering game not having an AEP % based on player skill level. Accordingly, the gaming system displays a Stage 3 map 430 that includes: (1) level symbols 431, 432, 433, 434, 436, 437, and 438 that respectively represent Levels 1, 2, 3, 4, 5, 6, and 7 of Stage 3; and (2) mystery award symbols 435 and 439 that represent mystery awards of Stage 3. The level and mystery award symbols 431 to 439 are positioned along a path (not labeled). A level indicator (here, an unlabeled arrow) indicates the level symbol 431 to indicate that player's current level is Level 1.

In this example embodiment: (1) the level advancement condition is satisfied for Level 1 when all target objects are destroyed; and (2) a level completion condition is satisfied for Level 1 when all target objects and all mystery boxes are destroyed. When the level advancement condition is satisfied for Level 1, the gaming system unlocks Level 2 (since the unlock condition is satisfied). When the level completion condition is satisfied for Level 1, the gaming system unlocks Level 2 (since the unlock condition is satisfied) and provides a level completion award in addition to any primary award the player wins for the play.

Figure 6A:
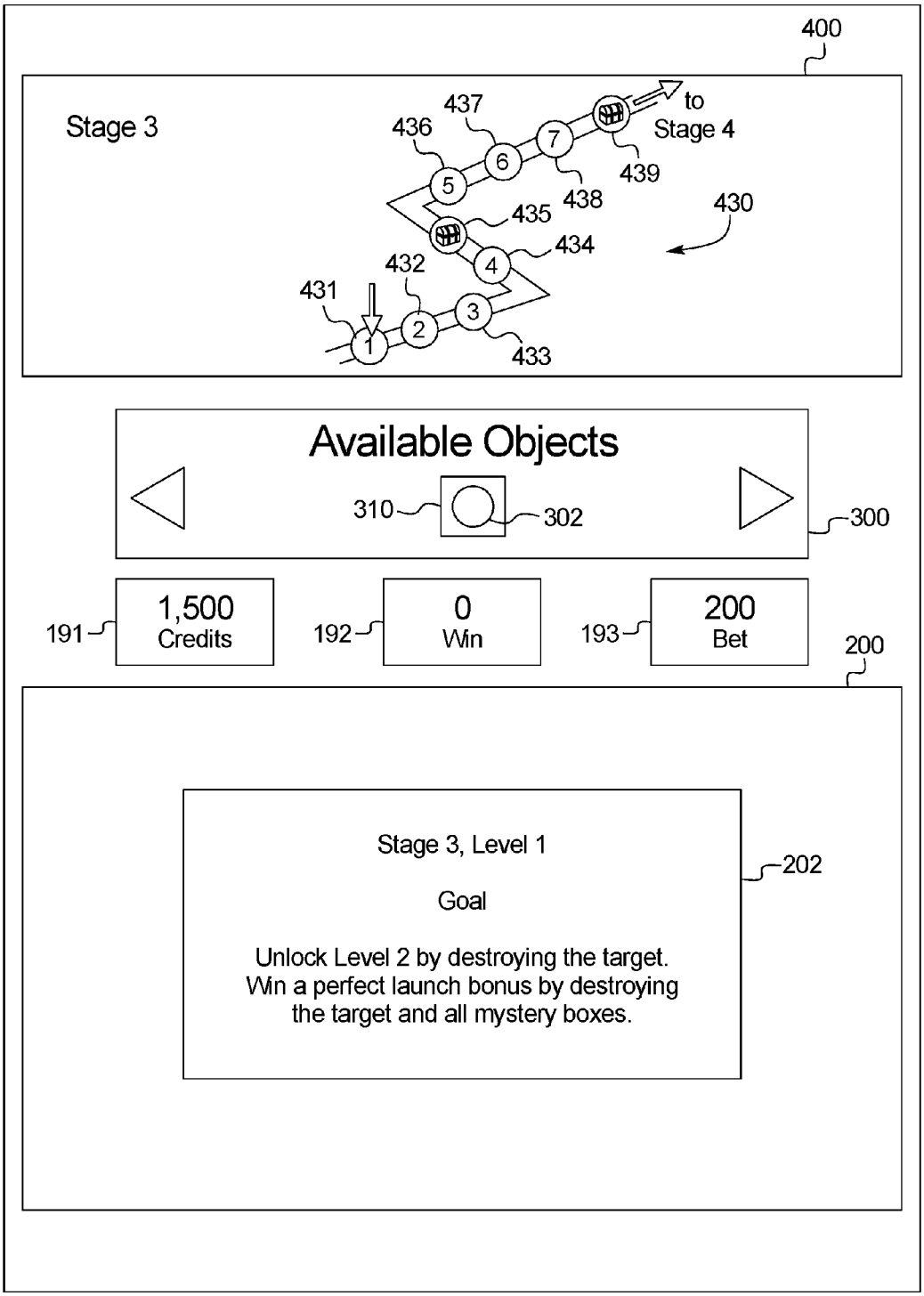
FIGS. 6A to 6E illustrate screen shots of one example embodiment of a gaming system operating an example primary skill-based wagering game not having an AEP % based on player skill level.

Turning to FIG. 6A, at this point the gaming system has received an actuation of a START button (not shown), and in response initiated a play of the skill-based wagering game at Stage 3, Level 1 and placed 200 credit bet. Upon initiation of the play, the gaming system displays a pop-up box 202 that indicates: (1) that the player must destroy all target objects (or any other suitable quantity of the target objects) to satisfy the level advancement condition and unlock Stage 3, Level 2; and (2) that the player must destroy all target objects and all mystery boxes to satisfy the level completion condition and unlock Stage 3, Level 2.

Figure 6B:
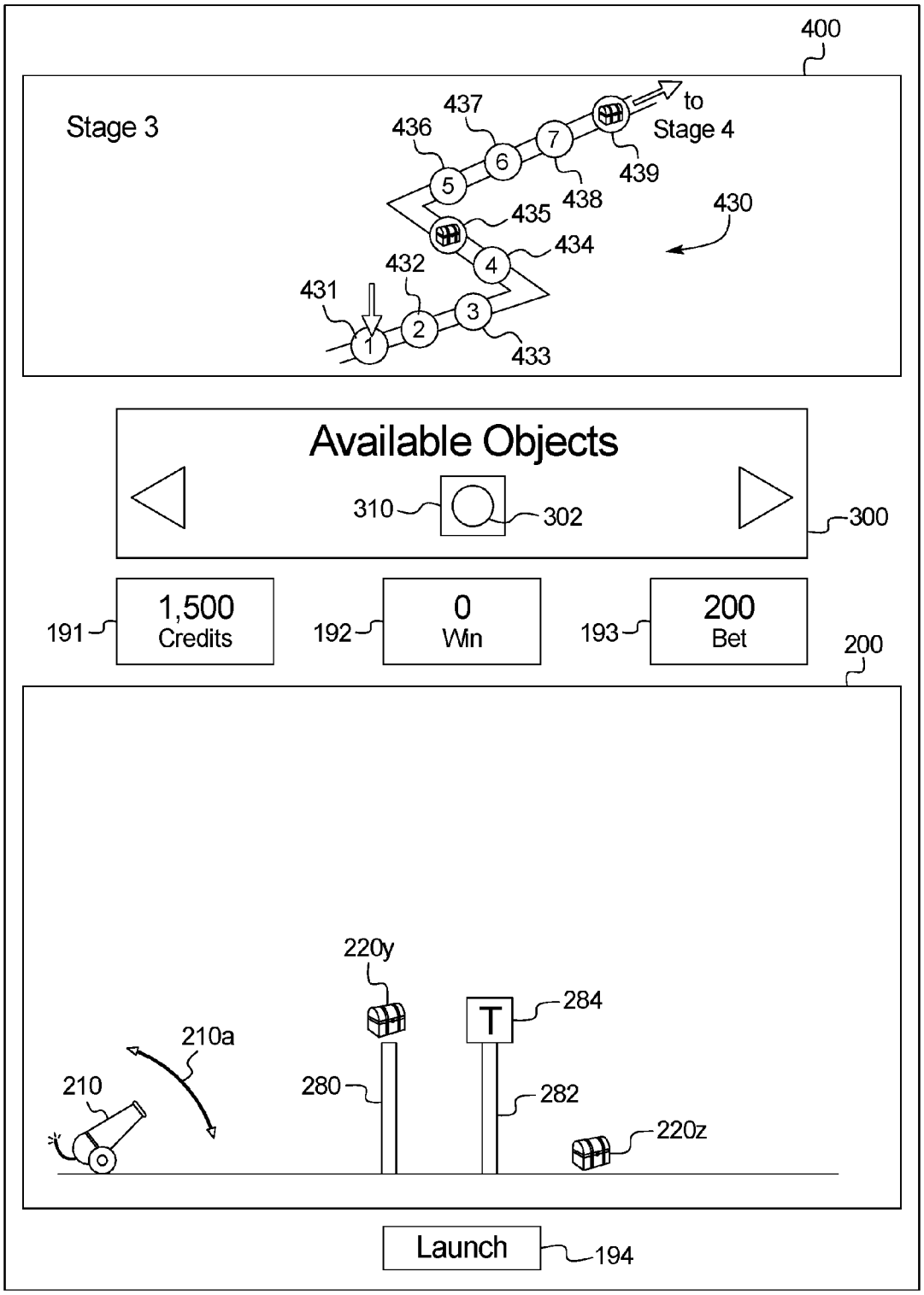

As shown in FIG. 6B, the gaming system displays an object launcher 210 from which the object 302 will be launched. The gaming system displays the object launcher 210 rotating up and down about a rotational axis near one end according to an arc 210*a* between forming a (minimum) 10 degree angle with the horizontal and a (maximum) 80 degree angle with the horizontal. The gaming system activates a LAUNCH button 194 and enables the player to provide a skill-based input by actuating the LAUNCH button 194. Responsive to receiving an actuation of the LAUNCH button 194, the gaming system stops rotating the object launcher 210 to set the launch angle of the object launcher 210 and launches the object 302 from the object launcher 210. Put differently, the gaming system continuously varies the launch angle of the object launcher 210, and stops doing so to set the launch angle and launch the object 302 responsive to an actuation of the LAUNCH button 194.

The gaming system also displays two non-award-generating objects 280 and 282, a target object 284, and two mystery boxes 220y and 220z (i.e., award-generating objects). These objects are positioned at predetermined areas of the game field, though in other embodiments some objects may be randomly positioned.

Figure 6C:
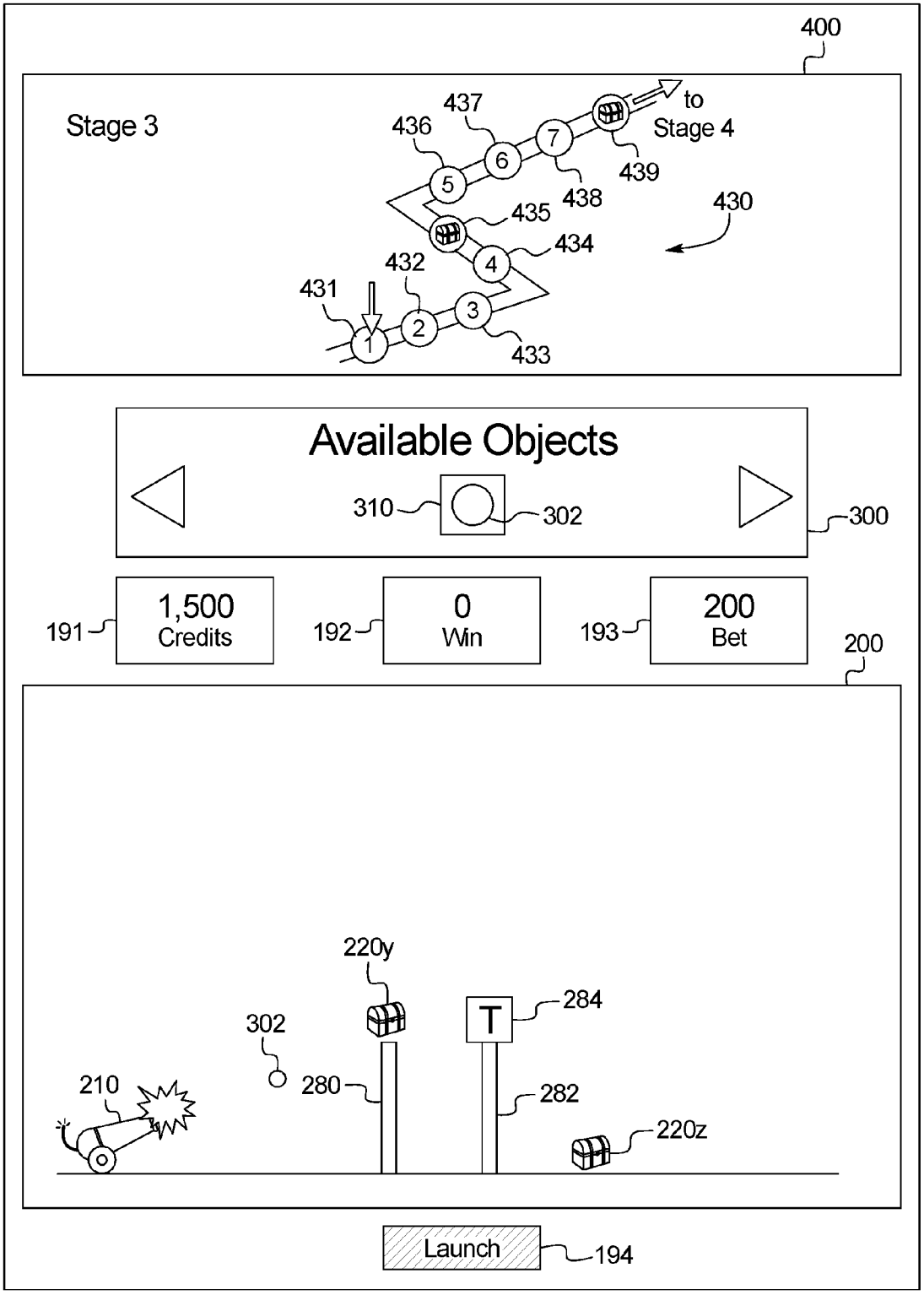
Figure 6D:
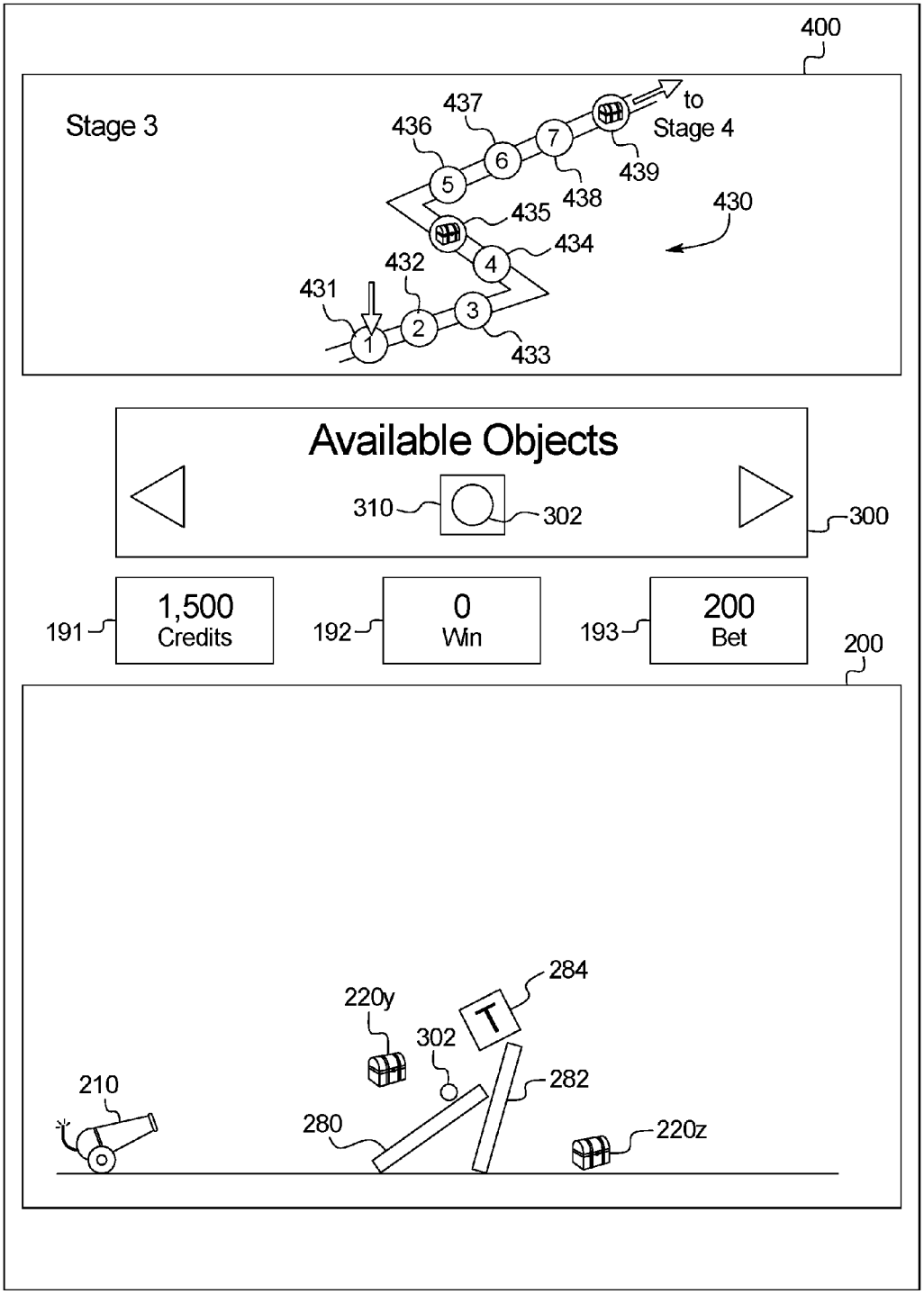
Figure 6E:
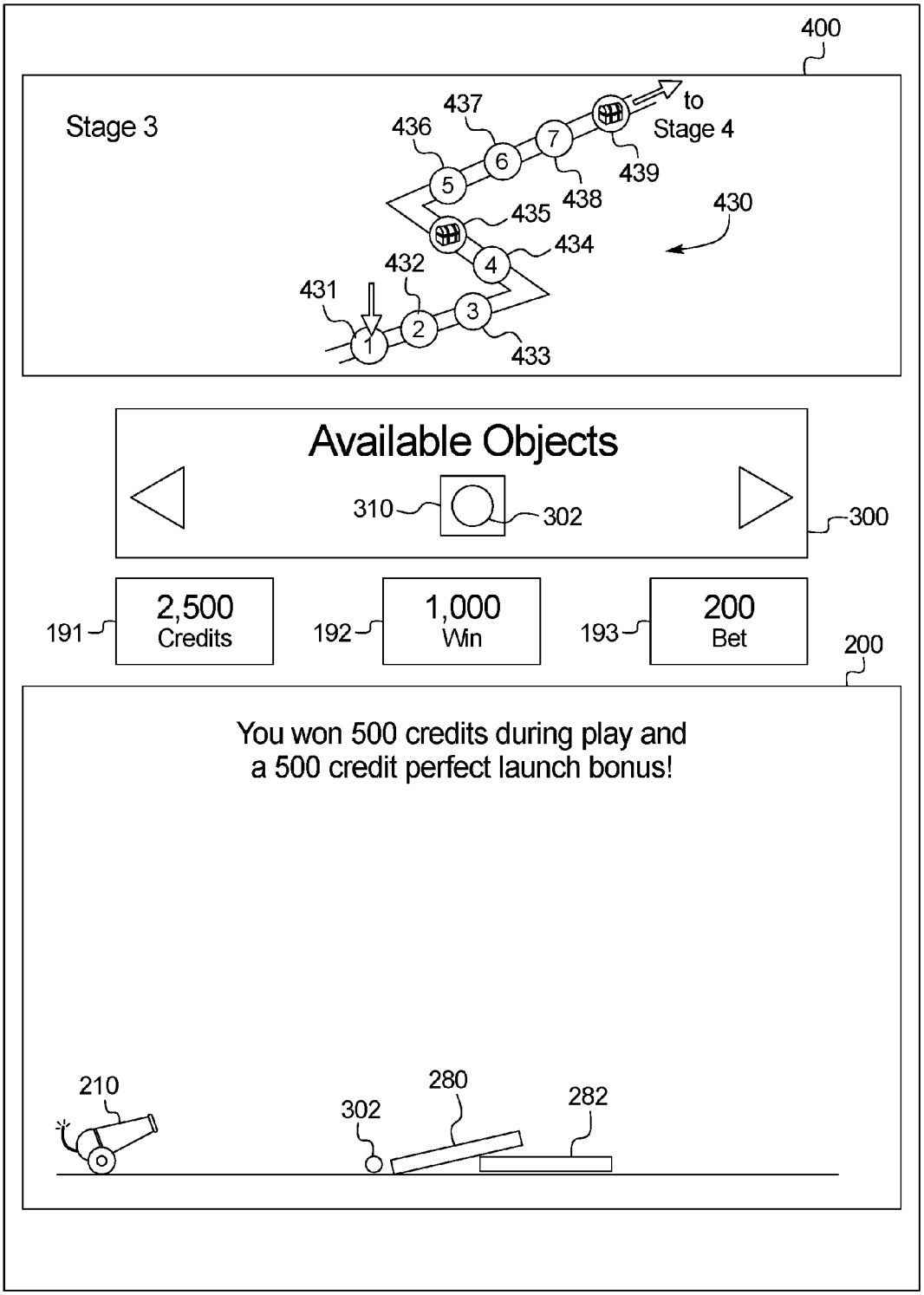

Turning to FIG. 6C, the gaming system receives an actuation of the LAUNCH button 194—i.e., a skill-based input—and launches the object 302 into the game field. Once launched, a suitable physics engine determines how the object 302 behaves and interacts with the objects in the game field based on a variety of factors, such as is described in U.S. Pat. No. 9,358,453, which is incorporated herein by reference. More specifically, the gaming system uses the physics engine to determine whether to destroy the mystery boxes 220y and 220z and the target object 284 based on movement of the object 302 and/or any of the other displayed objects. Here, as shown in FIGS. 6D and 6E, the object 302 knocks over the non-award-generating object 280, which then knocks over the non-award-generating object 282. This destroys both mystery boxes 220y and 220z and the target object 284. Accordingly, the gaming system provides a 500 credit primary award (250 credits for each destroyed mystery box) and a 500 credit level completion award (since both mystery boxes and the target object were destroyed) in addition to the 500 credit primary award. The gaming system unlocks Stage 3, Level 2 since the level completion condition was satisfied.

In certain embodiments, the gaming system uses a random determination to (in part) determine whether the level-completion condition is satisfied and provide the level-completion bonus. In one embodiment, when the object destroys the final award-generating object (e.g., mystery box), the gaming system randomly determines (such as via a weighted table) whether destruction of the final award-generating object will result in satisfying the level-completion condition. In another embodiment, the gaming system displays a multiplier object in the game field along with the award-generating object(s), the target object(s), and the non-award-generating object(s). In this embodiment, the level-completion condition is satisfied when: (1) the object destroys all award-generating objects and target objects; (2) the object collides with the multiplier object; and (3) based on the collision, the gaming system randomly determines to move the multiplier object to reveal a multiplier or bonus credit award.

4. Variations

As indicated above, the gaming system enables the player to use an object of a set of one or more objects for a play of the skill-based wagering game. In various embodiments, one or more objects are initially unlocked and included in the set while other objects are locked. The gaming system adds a locked object to the set (so the player can use that object during gameplay) when an object unlock event occurs. An object unlock event may be any suitable event such as, but not limited to: the unlocking of a particular stage, the unlocking of a particular level, the occurrence of a designated event during play of a particular level, the occurrence of a particular event during play of a different game, the redemption of a promotion, an exchange of a particular quantity of monetary or non-monetary credits (such as in-game virtual currency won during play of the skill-based wagering game), a random mystery event, a level of the player's avatar reaching a certain threshold, or upgrading or enhancing an object's abilities or characteristics (e.g., upgrading an object with scuba gear enables an under-water level). Different object may have different object unlock events.

Objects may differ in a variety of different ways. Different objects have different appearances and may differ in size and shape. Different object may also have different (simulated) material properties so they function differently when launched and when they collide with objects post-launch. In certain embodiments, the differences among the objects do not affect the outcome of a play of the skill-based wagering game, but affect how gameplay is displayed. In other embodiments, the differences among the objects affect the outcome of a play of the skill-based game. For instance, certain objects are heavier and stronger than others, meaning they can cause more damage but not travel as far.

In various embodiments, different objects have different available post-launch features that the gaming system enables the player to selectively use to modify certain aspects of gameplay. Some examples of post-launch features include:

- a feature that causes extra damage in a particular area of the game field;
- a feature that causes the object to split into multiple objects or spawn one or more objects;
- a feature that causes the object to move more quickly;
- a feature that causes the object to move in a particular direction;
- a feature that causes the object to shoot a projectile;
- a feature that makes the object invulnerable for a period; and/or
- a feature that destroys the object and any objects within a particular vicinity of the object.

The gaming system accumulates in-game virtual currency for the player responsive to events that occur during, associated with, or in certain embodiments not associated with game play. For instance, the gaming system randomly displays virtual currency symbols in the game field and provides in-game virtual currency when the player's object collides with those symbols. In another example, the gaming system provides in-game virtual currency when the player has completed a particular quantity of levels. In another example, the gaming system provides in-game virtual currency when the player signs up for a player tracking account. In other examples, the gaming system provides in-game virtual currency based on the object reaching certain launch distances and heights, colliding with mystery boxes, knocking over or destroying other objects, and winning awards.

The gaming system enables the player to use the in-game virtual currency in a variety of manners, such as to purchase vanity upgrades for objects (e.g., different accessories) or feature upgrades for objects (e.g., adding features to an object or making a feature the object already has more powerful).

Different stages may have different themes, and each level in a particular stage shares the theme of that stage. In certain embodiments, the levels become more difficult to advance through or complete as the player progresses. In some embodiments, the maximum AEP % increases as the levels' difficulty level increases. So, for instance, levels in higher stages are more difficult than—but potentially more lucrative than—levels in lower stages. In certain embodiments, once a level is unlocked, the gaming system enables the player to play that level at any later point in time. This enables the player to, for instance, play her favorite levels again or to play a level again to try to satisfy the level completion condition.

Different levels may be associated with different unlock events. For instance, a level may be associated with an unlock event that occurs when the level completion condition has been satisfied for each preceding level in the stage (or in the stage and all previous stages). In another example, a level may be associated with an unlock event that occurs when (1) the level completion condition has been satisfied for the previous level and (2) the player's in-game virtual currency balance exceeds a particular threshold.

In certain embodiments, when a player unlocks a new stage (such as by satisfying the level advancement condition in the final level of the previous stage), the gaming system dynamically creates that stage by selecting (such as randomly) a designated quantity of levels from a pool of potential levels for that stage. This keeps the game fresh and makes it likely that players will have different experiences as they progress through the levels and stages of the skill-based wagering game. In certain embodiments, some of the stages (such as the first stage or the first two stages) have a predetermined set of levels arranged in a predetermined order along the path, and the gaming system dynamically generates later stages.

In various embodiments, the skill-based wagering game is a personal persistence game that enables the player to save her progress at the end of a gaming session and pick up where she left off upon the start of a new gaming session. The gaming system may, for instance, store the player's progress in association with the player's player tracking account, and enable the player to pick up where she left off when she initiates another gaming session by identifying herself (such as with her player tracking card).

Other embodiments may have a different object launcher mechanic. For instance, in another embodiment, the gaming system doesn't continuously rotate the object launch to vary the launch angle, but instead enables the player to directly aim the object launcher, thereby directly determining the object launch angle.

In certain embodiments, the gaming system enables the player to provide a plurality of skill-based inputs related to the introduction of the object into the game field. In one embodiment, the gaming system receives a skill-based input that the gaming system uses to determine the force at which the object launcher will launch the object into the game field. For instance, the gaming system may display a power meter that cycles between nearly empty and full, and sets a power level based on how full the power meter is when a skill-based input is received (e.g., an actuation of an input device or a player releasing an input device).

The gaming system may impose any suitable limits on the launch angle. In the embodiment described above with respect to FIGS. 2A-2E, the gaming system limits the launch angle to between 10 and 80 degrees. That is, the gaming system prevents the launch angle from being 0-9 or 81-90 degrees. In other embodiments, the gaming system doesn't limit the launch angle or limits the launch angle even more. The launch angle limitations may differ from level to level. In some embodiments, the gaming system associates a 0% AEP % with certain launch angles, such as 0 or 90 degree launch angles.

The gaming system may, in certain embodiments, randomly determine to position mystery boxes along the object path to provide the player an award in addition to monetary credits that count toward the total primary award value the player will win for the play of the skill-based wagering game. The mystery boxes may include any suitable awards such as, but not limited to: in-game virtual currency, a quantity of one or more free plays of a game (such as a bonus game), items a player may use to upgrade the appearance of or the performance of an object, boosts usable to increase the likelihood of the level advancement and/or level completion condition being satisfied in the current play, promotional credits, enhancements, and/or an increase in AEP %. In certain embodiments, the gaming system is more likely to position mystery boxes along the object path when the determined total primary award level is relatively low.

In certain embodiments, for each play of the skill-based wagering game, the gaming system randomly determines whether to provide a bonus award in addition to any other awards won during game play. In certain embodiments, the probability of the gaming system determining to provide the bonus award increases as the value of the award(s) the player won via contacting awards with objects decreases. In these embodiments, the gaming system may use the bonus award as a consolation award. In certain embodiments, one or more events that occur during play of the skill-based wagering game affect the gaming system's determination of whether to provide the bonus award and/or the value of the bonus award.

In various embodiments, while the gaming system displays the player's object traveling along the object path, the gaming system displays one or more indicators (such as signposts) that indicate the results of other players' object launches (i.e., where the object paths of other players' objects have ended). This enables the player to compare her launches to other players' launches. In some of these embodiments, the other players are players at the same gaming establishment, within a designated vicinity of the player, or within the same state as the player. In one embodiment, the other players are players on the player's friends list, which the player may create or which the gaming system can import from one of the player's social media accounts. The results may be limited to a certain time frame (e.g., results from the past year, 6 months, 3 months, 1 month, 2 weeks, 1 day, etc.).

In certain embodiments, the gaming system provides a skill-based bonus game responsive to an occurrence of a bonus-triggering event, such as the object colliding with a particular mystery box. The skill-based bonus game may be of any of the types of skill-based wagering games described herein (or any other types of skill-based wagering games).

In certain embodiments, when a particular condition is met the gaming system displays a launched object leaving the game field and traveling to other areas on the display device, such as into the map area or even to the top box of the EGM or to the player's mobile device. The gaming system may provide an additional award when this occurs.

In certain embodiments, the gaming system determines a persistent score for the player based on her performance during game play, such as based on how many awards she has won, how many levels and stages she has advanced through or completed, how upgraded her objects are, how much in-game virtual currency she has, her avatar's level, her upgrade progress, her game progress, her longest launch, her highest launch, her fastest object speed, and/or her highest amount of damage. The gaming system may periodically update a leaderboard that ranks players based on their scores. This leaderboard is available to all players. In certain embodiments, the gaming system decreases the player's score when a player hasn't played the skill-based wagering game for a particular period. For instance, if the player hasn't played the skill-based wagering game for two weeks, the gaming system reduces the player's score 5% per week until the player plays again. The gaming system may enter players having scores above a particular threshold into drawings to win prizes or, alternatively, randomly provide bonus awards to players having scores above a particular threshold.

In various embodiments, the gaming system enables players to compete against one another with the gaming system retaining a percentage of the total bet. For instance, the gaming system enables players to directly challenge each other or to create challenges and broadcast them to all players (or a subset of players, such as those at a similar skill level of the challenging player, players on their friends list, or players who are eligible at a certain skill level to receive such challenges), who can determine whether to accept the challenge. Once a challenge is accepted, the players independently play a version of the above-described skill-based wagering game, and the player who performs best wins (e.g., the player who launches her object the furthest, plays optimally, or destroys all target objects). The gaming system may enable each player to modify the other's game field in one or more ways before launch (e.g., by positioning an obstacle in the game field). The gaming system in certain embodiments enables competitions including more than two players.

The present disclosure contemplates that any of the other variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM; (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's wager or wager level; (17) determined independent of the player's wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; or (26) determined in any other suitable manner or based on or independent of any other suitable factor(s).

5. Gaming Systems

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices.

Thus, in various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, the term "EGM" is used herein to refer to an electronic gaming machine (such as a slot machine, a video poker machine, a video lottery terminal (VLT), a video keno machine, or a video bingo machine located on a casino floor). Additionally, for brevity and clarity and unless specifically stated otherwise, "EGM" as used herein represents one EGM or a plurality of EGMs, "personal computing device" as used herein represents one personal computing device or a plurality of personal computing devices, and "central server, central controller, or remote host" as used herein represents one central server, central controller, or remote host or a plurality of central servers, central controllers, or remote hosts.

Figure 7:
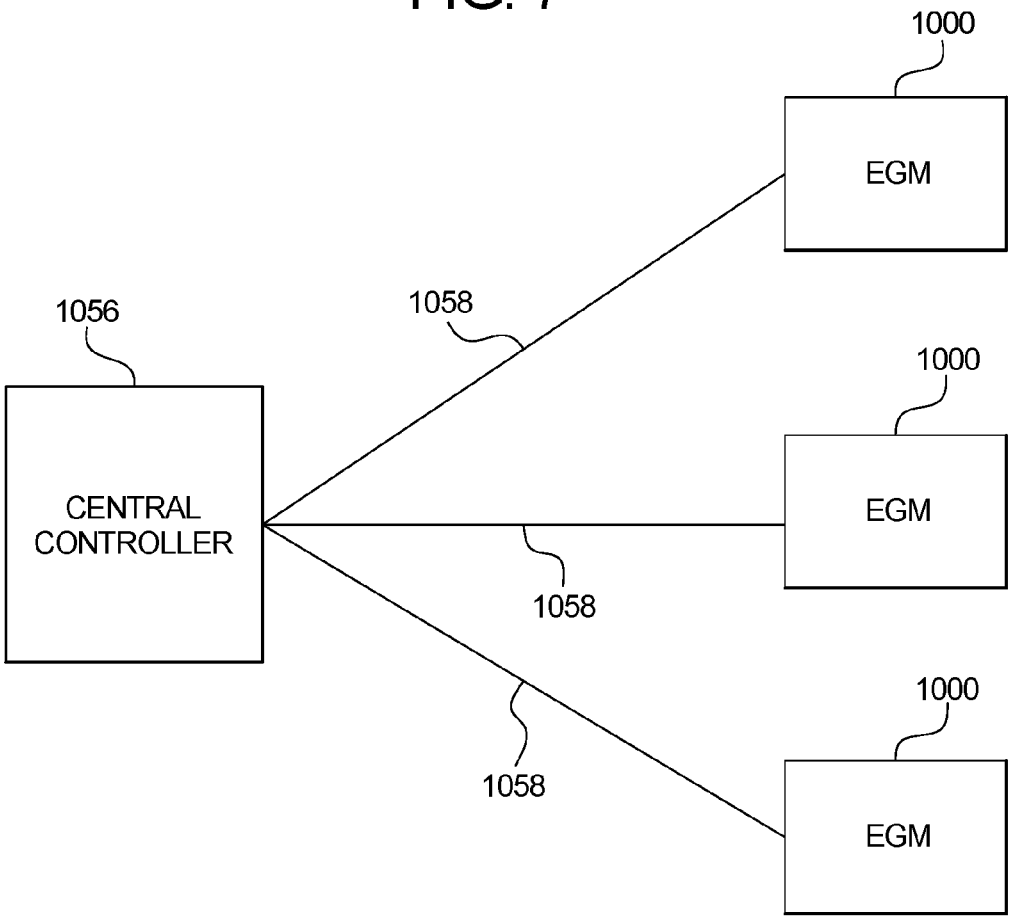
FIG. 7 is a schematic block diagram of one embodiment of a network configuration of the gaming system of the present disclosure.

As noted above, in various embodiments, the gaming system includes an EGM (or personal computing device) in combination with a central server, central controller, or remote host. In such embodiments, the EGM (or personal computing device) is configured to communicate with the central server, central controller, or remote host through a data network or remote communication link. In certain such embodiments, the EGM (or personal computing device) is configured to communicate with another EGM (or personal computing device) through the same data network or remote communication link or through a different data network or remote communication link. For example, the gaming system illustrated in FIG. 7 includes a plurality of EGMs 1000 that are each configured to communicate with a central server, central controller, or remote host 1056 through a data network 1058.

In certain embodiments in which the gaming system includes an EGM (or personal computing device) in combination with a central server, central controller, or remote host, the central server, central controller, or remote host is any suitable computing device (such as a server) that includes at least one processor and at least one memory device or data storage device. As further described herein, the EGM (or personal computing device) includes at least one EGM (or personal computing device) processor configured to transmit and receive data or signals representing events, messages, commands, or any other suitable information between the EGM (or personal computing device) and the central server, central controller, or remote host. The at least one processor of that EGM (or personal computing device) is configured to execute the events, messages, or commands represented by such data or signals in conjunction with the operation of the EGM (or personal computing device). Moreover, the at least one processor of the central server, central controller, or remote host is configured to transmit and receive data or signals representing events, messages, commands, or any other suitable information between the central server, central controller, or remote host and the EGM (or personal computing device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal computing device). Further, one, more than one, or each of the functions of the at least one processor of the EGM (or personal computing device) may be performed by the at least one processor of the central server, central controller, or remote host.

In certain such embodiments, computerized instructions for controlling any games (such as any primary or base games and/or any secondary or bonus games) displayed by the EGM (or personal computing device) are executed by the central server, central controller, or remote host. In such "thin client" embodiments, the central server, central controller, or remote host remotely controls any games (or other suitable interfaces) displayed by the EGM (or personal computing device), and the EGM (or personal computing device) is utilized to display such games (or suitable interfaces) and to receive one or more inputs or commands. In other such embodiments, computerized instructions for controlling any games displayed by the EGM (or personal computing device) are communicated from the central server, central controller, or remote host to the EGM (or personal computing device) and are stored in at least one memory device of the EGM (or personal computing device). In such "thick client" embodiments, the at least one processor of the EGM (or personal computing device) executes the computerized instructions to control any games (or other suitable interfaces) displayed by the EGM (or personal computing device).

In various embodiments in which the gaming system includes a plurality of EGMs (or personal computing devices), one or more of the EGMs (or personal computing devices) are thin client EGMs (or personal computing devices) and one or more of the EGMs (or personal computing devices) are thick client EGMs (or personal computing devices). In other embodiments in which the gaming system includes one or more EGMs (or personal computing devices), certain functions of one or more of the EGMs (or personal computing devices) are implemented in a thin client environment, and certain other functions of one or more of the EGMs (or personal computing devices) are implemented in a thick client environment. In one such embodiment in which the gaming system includes an EGM (or personal computing device) and a central server, central controller, or remote host, computerized instructions for controlling any primary or base games displayed by the EGM (or personal computing device) are communicated from the central server, central controller, or remote host to the EGM (or personal computing device) in a thick client configuration, and computerized instructions for controlling any secondary or bonus games or other functions displayed by the EGM (or personal computing device) are executed by the central server, central controller, or remote host in a thin client configuration.

In certain embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a local area network (LAN) in which the EGMs (or personal computing devices) are located substantially proximate to one another and/or the central server, central controller, or remote host. In one example, the EGMs (or personal computing devices) and the central server, central controller, or remote host are located in a gaming establishment or a portion of a gaming establishment.

In other embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a wide area network (WAN) in which one or more of the EGMs (or personal computing devices) are not necessarily located substantially proximate to another one of the EGMs (or personal computing devices) and/or the central server, central controller, or remote host. For example, one or more of the EGMs (or personal computing devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal computing devices) are located. In certain embodiments in which the data network is a WAN, the gaming system includes a central server, central controller, or remote host and an EGM (or personal computing device) each located in a different gaming establishment in a same geographic area, such as a same city or a same state. Gaming systems in which the data network is a WAN are substantially identical to gaming systems in which the data network is a LAN, though the quantity of EGMs (or personal computing devices) in such gaming systems may vary relative to one another.

In further embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is an internet (such as the Internet) or an intranet. In certain such embodiments, an Internet browser of the EGM (or personal computing device) is usable to access an Internet game page from any location where an Internet connection is available. In one such embodiment, after the EGM (or personal computing device) accesses the Internet game page, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM (or personal computing device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal computing device). Examples of implementations of Internet-based gaming are further described in U.S. Pat. No. 8,764,566, entitled "Internet Remote Game Server," and U.S. Pat. No. 8,147,334, entitled "Universal Game Server," which are incorporated herein by reference.

The central server, central controller, or remote host and the EGM (or personal computing device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal computing devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

6. EGM Components

Figure 8:
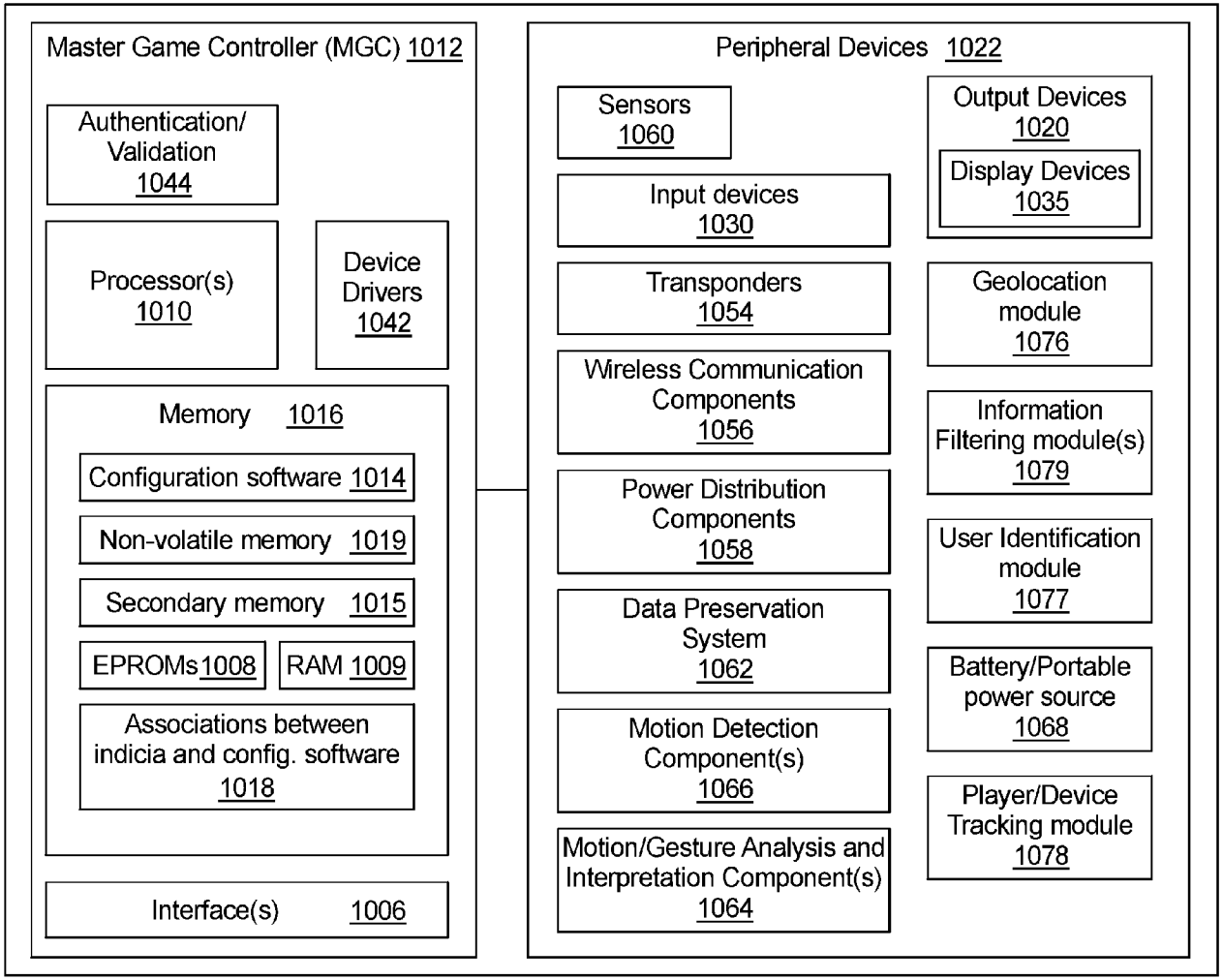
FIG. 8 is a schematic block diagram of an example electronic configuration of the gaming system of the present disclosure.
Figure 9A:
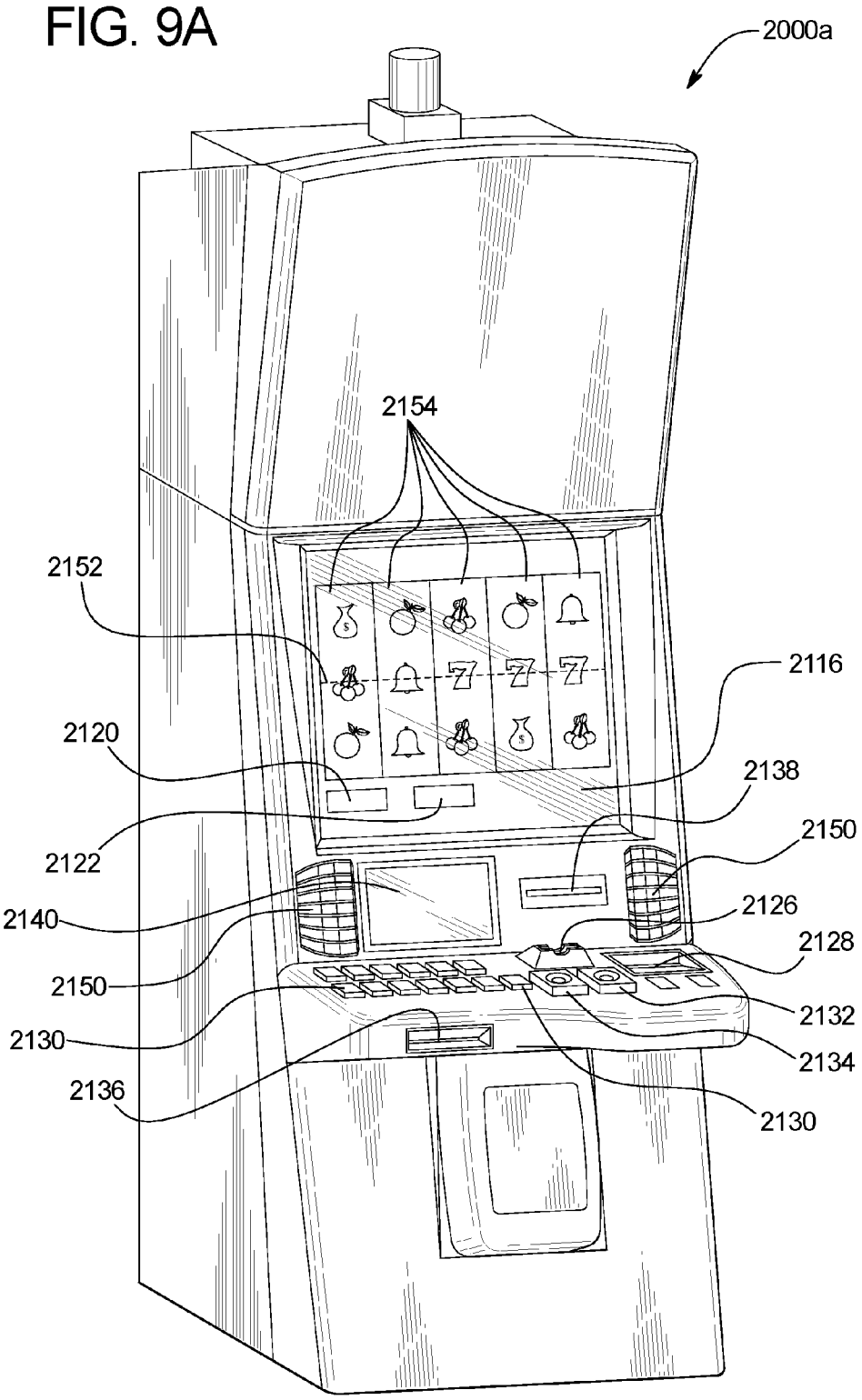
FIGS. 9A and 9B are perspective views of example alternative embodiments of the gaming system of the present disclosure.
Figure 9B:
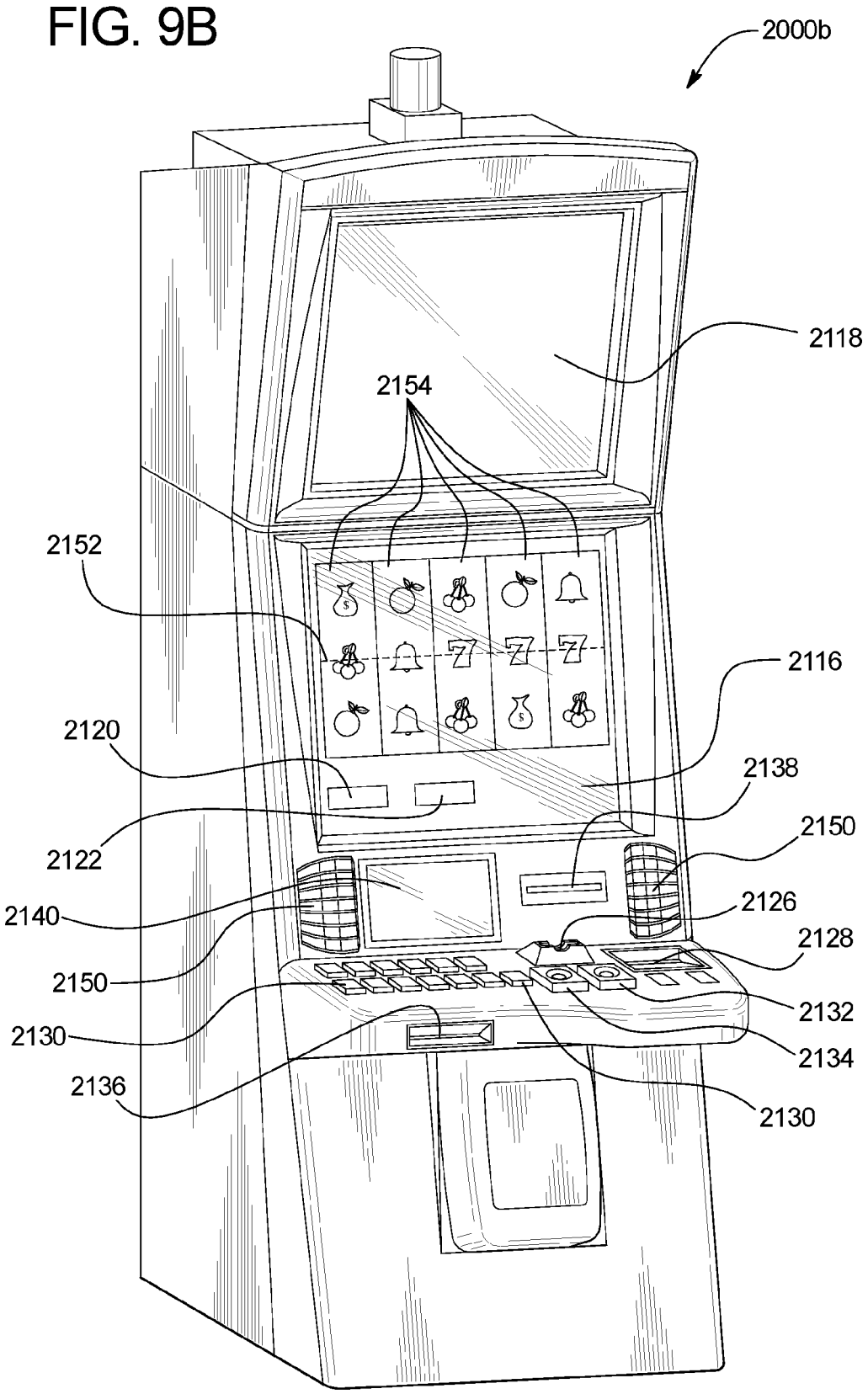
Figure 9C:
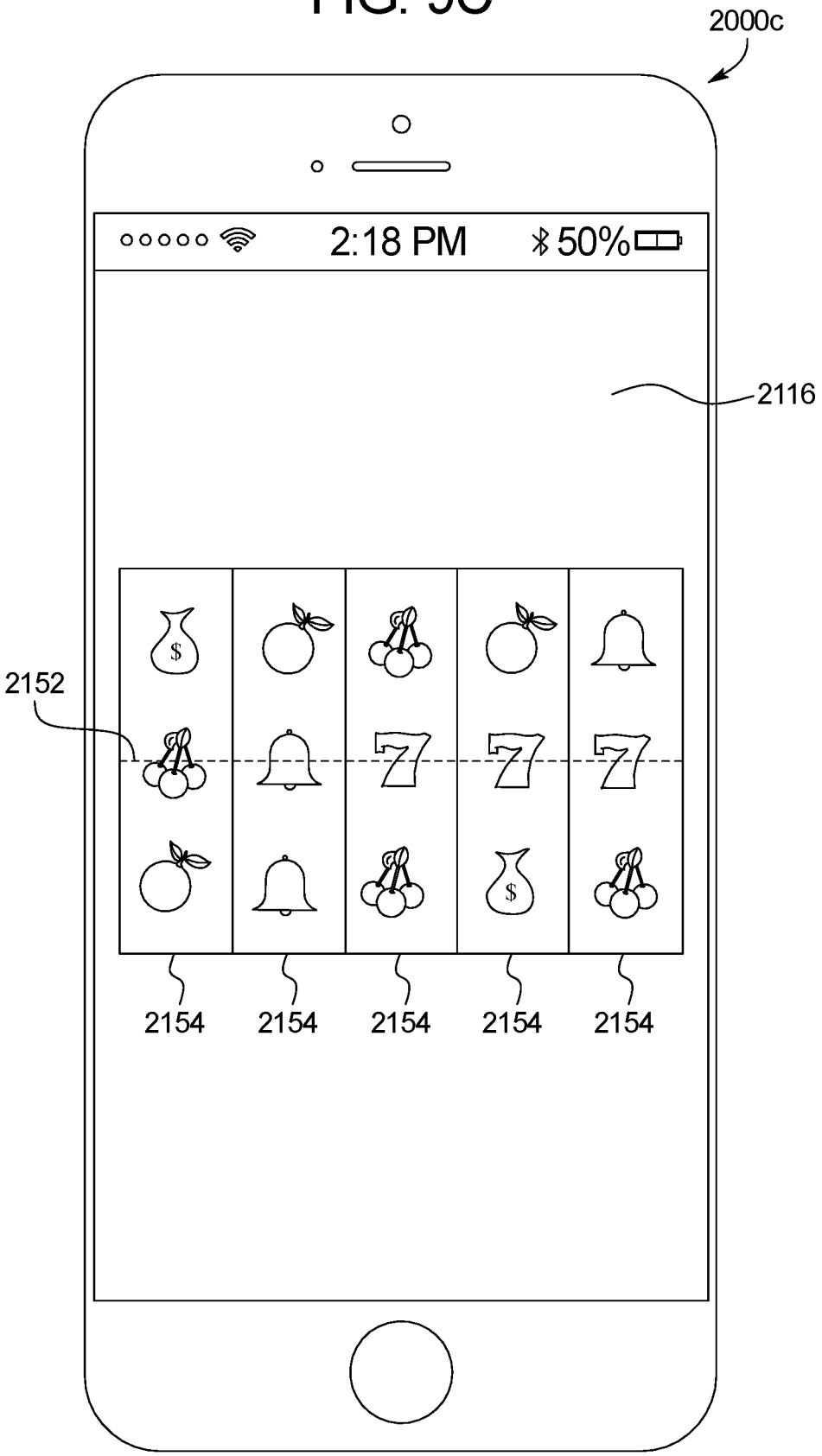
FIG. 9C is a front view of an example personal gaming device of the gaming system disclosed herein.

FIG. 8 is a block diagram of an example EGM 1000 and FIGS. 9A and 9B include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*. Although the below refers to EGMs, in various embodiments personal gaming devices (such as persona gaming device 2000*c* of FIG. 9*c*) may include some or all of the below components.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets," which is incorporated herein by reference.

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 2000*a* illustrated in FIG. 9A includes a central display device 2116, a player tracking display 2140, a credit display 2120, and a bet display 2122. The example EGM 2000*b* illustrated in FIG. 9B includes a central display device 2116, an upper display device 2118, a player tracking display 2140, a credit display 2120, and a bet display 2122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 9A and 9B each include a ticket printer and dispenser 2136. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; U.S. Pat. No. 6,048,269, entitled "Coinless Slot Machine System and Method"; and U.S. Pat. No. 5,290,003, entitled "Gaming Machine and Coupons," which are incorporated herein by reference.

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine," which is incorporated herein by reference.

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 9A and 9B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrated in FIGS. 9A and 9B each include a combined bill and ticket acceptor 2128 and a coin slot 2126.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine," which is incorporated herein by reference. When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 9A and 9B each include a game play activation device in the form of a game play initiation button 2132. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGMs 2000*a* and 2000*b* illustrated in FIGS. 9A and 9B each include a cashout device in the form of a cashout button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 9A and 9B each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and 2000*b* illustrated in FIGS. 9A and 9B each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.)

and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGMs 2000*a* and 2000*b* illustrated in FIGS. 9A and 9B, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 9A and 9B, EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

7. Operation of Primary or Base Games and/or Secondary or Bonus Games

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game," which are incorporated herein by reference.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern," which are incorporated herein by reference.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services," which are incorporated herein by reference.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM **2000*b* shown in FIG. 9B includes a payline 1152 and a plurality of reels 1154**. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations," which are incorporated herein by reference.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. Examples of progressive gaming systems are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards," which are incorporated herein by reference As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win," which are incorporated herein by reference.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services," which are incorporated herein by reference.

8. Differentiating Certain Gaming Systems from General Purpose Computing Devices Certain of the gaming systems described herein, such as EGMs located in a casino or another gaming establishment, include certain components and/or are configured to operate in certain manners that differentiate these systems from general purpose computing devices, i.e., certain personal gaming devices such as desktop computers and laptop computers.

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are not state-based machines, and a majority of data is usually lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes," which are incorporated herein by reference.

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just prior to the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just prior to when the malfunction occurred. The restored state may include metering information and graphical information that was displayed on the EGM in the state prior to the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just prior to the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM prior to, during, and/or after the disputed game to demonstrate whether the player was correct or not in her assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play," which are incorporated herein by reference.

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification," which is incorporated herein by reference.

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment," which is incorporated herein by reference.

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System," which is incorporated herein by reference.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a processor; and a memory device that stores a plurality of instructions that, when executed by the processor, cause the processor to:

receive a skill-based input from a player via an input device;

determine, based on the skill-based input, an average expected payback percentage from a set of average expected payback percentages ranging from a minimum average expected payback percentage to a maximum average expected payback percentage;

randomly determine, in accordance with the determined average expected payback percentage, one or more primary awards;

determine an object path through a game field;

for each of the one or more primary awards, position an award symbol corresponding to the primary award in the game field and along the object path;

cause a display device to display an object traveling along the determined object path through at least part of the game field and colliding with the one or more award symbols; and provide the one or more primary awards.

2. The gaming system of claim 1, wherein the plurality of instructions, when executed by the processor, cause the processor to operate with the display device to display an object launcher launching the object onto the determined object path.

3. The gaming system of claim 2, wherein the plurality of instructions, when executed by the processor, cause the processor to determine a launch angle of the object launcher based on the skill-based input.

4. The gaming system of claim 3, wherein a first launch angle is associated with a first average expected payback percentage of the set, and wherein a second launch angle different from the first launch angle is associated with a second average expected payback percentage of the set different from the first average expected payback percentage.

5. The gaming system of claim 4, wherein the first launch angle is an optimal launch angle and the first average expected payback percentage is the maximum average expected payback percentage, and wherein the second launch angle is a worst launch angle and the second average expected payback percentage is the minimum average expected payback percentage.

6. A gaming system comprising:

a processor; and a memory device that stores a plurality of instructions that, when executed by the processor, cause the processor to:

receive a skill-based input from a player via an input device;

determine, based on the skill-based input, an average expected payback percentage from a set of average expected payback percentages ranging from a minimum average expected payback percentage to a maximum average expected payback percentage;

randomly determine, in accordance with the determined average expected payback percentage, one or more available primary awards;

determine an initial object path through at least part of a game field;

for each of the one or more primary awards, position an award symbol corresponding to the primary award in the game field, the award symbols positioned such that, with optimal play, the object will collide with all of the award symbols corresponding to the primary awards;

cause a display device to display an object traveling along the initial object path through at least part of the game field;

responsive to the object colliding with one of the award symbols, provide the corresponding award; and responsive to a post-launch skill event being triggered:

receive another skill-based input from the player via the input device;

determine a modified object path through at least part of the game field based on the other skill-based input; and cause the display device to display the object traveling along the modified object path through at least part of the game field.

7. The gaming system of claim 6, wherein the plurality of instructions, when executed by the processor, cause the processor to operate with the display device to display an object launcher launching the object onto the initial object path.

8. The gaming system of claim 7, wherein the plurality of instructions, when executed by the processor, cause the processor to determine a launch angle of the object launcher based on the skill-based input.

9. The gaming system of claim 8, wherein a first launch angle is associated with a first average expected payback percentage of the set, and wherein a second launch angle different from the first launch angle is associated with a second average expected payback percentage of the set different from the first average expected payback percentage.

10. The gaming system of claim 9, wherein the first launch angle is an optimal launch angle and the first average expected payback percentage is the maximum average expected payback percentage, and wherein the second launch angle is a worst launch angle and the second average expected payback percentage is the minimum average expected payback percentage.

11. The gaming system of claim 6, wherein the post-launch skill event is triggered based on the skill-based input.

12. The gaming system of claim 6, wherein the plurality of instructions, when executed by the processor, cause the processor to, following an occurrence of a termination event, if fewer than all of the one or more primary awards were provided, add the non-provided primary awards to a skill award pool.

13. A method of operating a gaming system, the method comprising:

receiving a skill-based input from a player via an input device;

determining via a processor, based on the skill-based input, an average expected payback percentage from a set of average expected payback percentages ranging from a minimum average expected payback percentage to a maximum average expected payback percentage;

randomly determining via the processor, in accordance with the determined average expected payback percentage, one or more primary awards;

determining via the processor, an object path through a game field;

for each of the one or more primary awards, positioning via the processor an award symbol corresponding to the primary award in the game field and along the object path;

causing a display device to display an object traveling along the determined object path through at least part of the game field and colliding with the one or more award symbols; and providing via the processor the one or more primary awards.

14. The method claim 13, which includes causing the display device to display an object launcher launching the object onto the determined object path.

15. The method claim 14, which includes causing the processor to determine a launch angle of the object launcher based on the skill-based input.

16. The method claim 15, wherein a first launch angle is associated with a first average expected payback percentage of the set, and wherein a second launch angle different from the first launch angle is associated with a second average expected payback percentage of the set different from the first average expected payback percentage.

17. The method claim 16, wherein the first launch angle is an optimal launch angle and the first average expected payback percentage is the maximum average expected payback percentage, and wherein the second launch angle is a worst launch angle and the second average expected payback percentage is the minimum average expected payback percentage.

18. A method of operating a gaming system, the method comprising:

receiving a skill-based input from a player via an input device;

determining via a processor, based on the skill-based input, an average expected payback percentage from a set of average expected payback percentages ranging from a minimum average expected payback percentage to a maximum average expected payback percentage;

randomly determining via the processor, in accordance with the determined average expected payback percentage, one or more available primary awards;

determining via the processor an initial object path through at least part of a game field;

for each of the one or more primary awards, positioning via the processor an award symbol corresponding to the primary award in the game field, the award symbols positioned such that, with optimal play, the object will collide with all of the award symbols corresponding to the primary awards;

causing a display device to display an object traveling along the initial object path through at least part of the game field;

responsive to the object colliding with one of the award symbols, providing via the processor the corresponding award; and responsive to a post-launch skill event being triggered:

receiving another skill-based input from the player via the input device;

determining via the processor a modified object path through at least part of the game field based on the other skill-based input; and causing the display device to display the object traveling along the modified object path through at least part of the game field.

19. The method of claim 18, which includes causing the display device to display an object launcher launching the object onto the initial object path.

20. The method claim 19, which includes causing the processor to determine a launch angle of the object launcher based on the skill-based input.

21. The method of claim 20, wherein a first launch angle is associated with a first average expected payback percentage of the set, and wherein a second launch angle different from the first launch angle is associated with a second average expected payback percentage of the set different from the first average expected payback percentage.

22. The method of claim 21, wherein the first launch angle is an optimal launch angle and the first average expected payback percentage is the maximum average expected payback percentage, and wherein the second launch angle is a worst launch angle and the second average expected payback percentage is the minimum average expected payback percentage.

23. The method of claim 18, wherein the post-launch skill event is triggered based on the skill-based input.

24. The method of claim 18, which includes causing the processor to, following an occurrence of a termination event, if fewer than all of the one or more primary awards were provided, adding the non-provided primary awards to a skill award pool.

* * * * *